US006283585B1

(12) United States Patent
Ikkatai et al.

(10) Patent No.: US 6,283,585 B1
(45) **Date of Patent: *Sep. 4, 2001**

(54) INK JET PRINTER WITH CARTRIDGE HAVING INTEGRAL STORAGE CHAMBER

(75) Inventors: Masatoshi Ikkatai, Yokohama; Hitoshi Fujimoto, Kawasaki; Tsuyoshi Mikoshiba, Sagamihara, all of (JP)

(73) Assignee: Canon Aptex, Inc., Ibaraki (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/094,626

(22) Filed: Jun. 15, 1998

Related U.S. Application Data

(62) Division of application No. 08/553,867, filed on Nov. 6, 1995, now Pat. No. 5,801,736.

(30) Foreign Application Priority Data

Nov. 7, 1994 (JP) ..... 6-272767
Nov. 7, 1994 (JP) ..... 6-272774

(51) Int. Cl.[7] ..... B41J 2/175

(52) U.S. Cl. ..... 347/85

(58) Field of Search ..... 347/84–86, 89, 347/92

(56) References Cited

U.S. PATENT DOCUMENTS

| | | | |
|---|---|---|---|
| 4,636,814 | 1/1987 | Terasawa . | |
| 4,677,488 | 6/1987 | Mizusawa et al. . | |
| 4,695,824 | 9/1987 | Tazaki . | |
| 4,700,202 | 10/1987 | Kuranishi et al. . | |
| 4,739,847 | 4/1988 | Terasawa | 177/140 |
| 4,772,900 | 9/1988 | Nagoshi . | |
| 4,965,596 | 10/1990 | Nagoshi et al. . | |
| 5,221,935 | 6/1993 | Uzita . | |
| 5,231,424 * | 7/1993 | Kaneko et al. | 347/89 |
| 5,506,611 | 4/1996 | Ujita et al. | 347/86 |
| 5,801,736 * | 9/1998 | Ikkatai et al. | 347/86 |

FOREIGN PATENT DOCUMENTS

| | | |
|---|---|---|
| 3042997 | 7/1982 | (DE) . |
| 4411873 | 10/1994 | (DE) . |
| 580433 | 1/1994 | (EP) . |
| 2147975 | 5/1985 | (GB) . |
| 2203386 | 10/1988 | (GB) . |
| 58-28385 | 2/1983 | (JP) . |
| 58-108153 | 6/1983 | (JP) . |
| 58-194561 | 11/1983 | (JP) . |
| 64-75249 | 3/1989 | (JP) . |

(List continued on next page.)

*Primary Examiner*—N. Le
*Assistant Examiner*—Judy Nguyen
(74) *Attorney, Agent, or Firm*—Fitzpatrick, Cella, Harper & Scinto

(57) ABSTRACT

A printer having an ink container, an ink jet head, and an ink storage container for temporarily storing ink to be supplied from the ink container to the ink-jet head, the ink storage container having a closable air communicating portion communicating with ambient air. A first ink path connects the ink container to the ink storage container, defines a flow of ink from the ink container to the ink storage container, and is provided with a one-way flow restricting member for permitting only a flow of ink in a direction of discharge from the ink container. A second ink path connects the ink storage container to the ink container and defines a flow of ink for returning an excess amount of ink over a predetermined liquid amount in the ink storage container to the ink container. An opening/closing member opens and closes the air communicating portion to ambient air. A buffer container is provided at a portion of the first ink path between the one-way flow restricting member and the ink storage container and is capable of maintaining a predetermined liquid amount. A transfer member transfers ink from the buffer container and is provided at a portion of the first ink path between the buffer container and the ink storage container.

12 Claims, 20 Drawing Sheets

FOREIGN PATENT DOCUMENTS

| | | |
|---|---|---|
| 1-299044 | 12/1989 | (JP) . |
| 3-5159 | 1/1991 | (JP) . |
| 3-7350 | 1/1991 | (JP) . |
| 3-247462 | 11/1991 | (JP) . |
| 4-44861 | 2/1992 | (JP) . |
| 4-364960 | 12/1992 | (JP) . |
| 6-12044 | 1/1994 | (JP) . |
| WO/89/10265 | 11/1989 | (WO) . |

* cited by examiner

INK JET PRINTER WITH CARTRIDGE HAVING INTEGRAL STORAGE CHAMBER

This application is a division of application Ser. No. 08/553,867 filed Nov. 6, 1995 now U.S. Pat. No. 5,801,736.

BACKGROUND OF THE INVENTION

1. Field of the Invention

The present invention relates generally to a printer and an ink cartridge to be widely used in POS, factory automation (FA), physical distribution (PD) and so forth, for example, and an ink cartridge to be employed in such printer. More specifically, the invention relates to a printer employing an ink-jet printing system and an ink cartridge to be used with such printer.

2. Description of the Related Art

Up to now, a label printer utilizing an ink-jet printing system has not been put into practical use. In general sense, advantages of an ink-jet printing are quietness in operation for not contacting with a printing medium, high printing speed, capability of high density printing, easiness of color printing, compactness in overall apparatus and so forth.

A paper, such as label, to be used in the label printer is smaller in size in comparison with normal paper, such as A4 paper and so forth, typically used in the office. Therefore, a full-line type printing head can be easily employed as a printing head for the label printer.

When the full-line type ink-jet head is employed, special construction different from the case where a normal serial type ink-jet head is employed, in ink recirculation for recovery of ejection, ink supply and so forth. Also, in such ink supply system, when a tube pump is employed as a driving source, derivative problem may be encountered in simplification of drive control.

On the other hard, in the ink-jet type label printer, it becomes necessary to appropriately manage ink to be used, including management of ink leakage in the apparatus and so forth. As a system which provides various advantages in ink management or ink supply management, an ink cartridge has been known. Namely, by making an individual cartridge storing the ink detachable with respect to the apparatus by inserting and removing an ink supply needle, the ink cartridge can be replaced with new one when the ink therein is spent out.

However, associating with the above-mentioned ink cartridge, problems may encountered in the label printer in management of waste ink and ink leakage upon detaching of the ink cartridge. Also, due to interference between the ink cartridge and the label printer body upon loading of the ink cartridge, a seal formed by an electrically resistant member provided on the ink cartridge for identification and so forth can be damaged.

SUMMARY OF THE INVENTION

It is an object of the present invention to provide a printer which can solve various problem derived in an ink supply system as set forth above, and particularly to provide a label printer which can solve the problems in the case where a tube pump is employed.

Another object of the present invention is to provide an ink cartridge which is employed in the label printer set forth above and permits appropriate management of waste ink.

According to one aspect of the invention, a printer having an ink-jet head ejecting an ink for performing printing on a printing medium, comprises an ink cartridge storing the ink to be supplied to the ink-jet head, ink storage means for temporarily storing the ink to be supplied from the ink cartridge to the ink-jet head, having an atmosphere communication opening and having an ink path for returning an excess amount of ink to the ink cartridge, buffer means connected to the ink cartridge via an ink path having an one-way valve permitting only flow of the ink from the ink cartridge, connected to the ink storage means via an ink path having a tube pump and connected to the ink-jet head via an ink passage having an one-way valve permitting only flow of the ink toward head ink-jet head, for maintaining the ink amount at a predetermined amount, and opening and closing means for opening and closing the atmosphere communication opening of the ink storage means.

Here, the printer may further comprise second buffer means connected to the ink-jet head via an ink path and connected to the ink storage chamber via an ink path having a second tube pump, for maintaining the ink amount at the predetermined amount.

On the other hand, the tube pump may guide a tube at portions other than a portion where a depression roller of the tube pump acts on the tube.

Also, the ink path for returning the excess amount of ink in the ink storage means to the ink cartridge may include a needle unit having a needle communicated with the inside of the ink cartridge associating with loading operation of the ink cartridge, the needle unit having a valve for establishing communication between the inside of the ink cartridge and the needle by loading operation of the ink cartridge.

Furthermore, a positional relationship between the ink cartridge and the needle unit upon loading of the ink cartridge may be that a communication opening of the needle penetrates within the ink cartridge and subsequently the valve is opened.

Also, the ink path connecting the ink cartridge and the buffer means may include a needle unit having a needle to be communicated with the inside of the ink cartridge associating with loading of the ink cartridge, the needle unit having a valve establishing communication between the ink cartridge and the needle by a suction pressure transmitted via the buffer means by driving of the tube pump.

The printer may further comprise means for manually opening and closing the atmosphere communication opening of the ink storage means.

Furthermore, the ink cartridge may include an ink storage chamber for storing the ink to be supplied to the ink-jet head and a waste ink storage chamber having an absorbing member for holding and storing the ink discharged from the printer, and the ink storage chamber and the waste ink storage chamber are formed integrally, and the waste ink storage chamber has two stage construction.

Also, the printer may further comprise a cartridge receptacle chamber, to which the ink cartridge is detachably loaded, and having a shutter member pivotably provided at an insertion opening for the ink cartridge and engaging with the outer surface of the ink cartridge when the ink cartridge is inserted for loading, the ink cartridge being provided with a resistant member depending upon information relating the ink cartridge, on the outer surface thereof, and the shutter member is formed into a configuration having a cut-out portion so as not to interfere with the resistant member upon engagement with the outer surface of the ink cartridge, It should be noted that the ink-jet head may eject the ink by generating a bubble of the ink utilizing a thermal energy and ejecting the ink by generation of the bubble.

According to the second aspect of the invention, an ink cartridge to be employed in a printer performing printing on a printing medium, comprises an ink storage chamber for storing an ink to be supplied to the printer, a waste ink storage chamber storing the ink discharged from the printer and having an absorbing member holding the ink, the ink storage chamber and the waste ink storage chamber being formed integrally and the waste ink storage chamber has two stage structure.

The waste ink storage chamber may be provided with a detection sensor for detecting presence of the ink.

Also, the detection sensor may be located at an upper stage of the two stage structure and defines by a given height of wall, in which the absorbing member is not present.

Furthermore, an ink inlet portion of the waste ink storage chamber may be provided at the lower stage of the two stage structure.

Also, ink supply for the printer and introduction of discharge of ink from the printer may be performed a supply needle inserted within the ink cartridge, and an absorbing member is provided at least at the portion where the supply needle is inserted.

According to the third aspect of the invention, an ink cartridge for storing an ink to be used by a printer for performing printing on a printing medium, characterized in that ink supply for the printer and introduction of discharge of ink from the printer is performed a supply needle inserted within the ink cartridge, and an absorbing member is provided at least at the portion where the supply needle is inserted.

With the present invention, when the ink is forcedly fed from the ink storage chamber to the ink-jet head by means of the tube pump, influence of the pulsation of the pressure induced by the tube pump can be successfully avoided. Also, since interference between the depression roller and the tube in the tube pump can be successfully avoided, the problem of cutting of the tube by the depression roller can be prevented. Also, associating with the detachable ink cartridge, connection of the ink cartridge and the ink supply system can be performed without causing leakage. Furthermore, since the atmosphere communication opening of the ink storage chamber can be opened and closed by manual operation, leakage of the ink through the atmosphere communication opening during transportation can be successfully avoided. As a result, the printer having the ink supply system which can perform satisfactory ink supply can be provided.

In addition, the waste ink flowing into the ink cartridge can be maintained therein. Also, since the presence of the ink is detected only when the waster ink chamber is filled with the waster ink, error in detecting the waste ink with accumulation of small amount of the waste ink to cause erroneous exchange of the ink cartridge may not be caused. Furthermore, upon piercing and removing of the supply needle associating with loading and unloading of the ink cartridge, since the ink adhering on the supply needle can be removed by the absorbing member, leakage of the ink will not be caused. In addition, upon loading of the ink cartridge, interference between the shutter member and the resistant member on the ink cartridge can be avoided. As a result, it becomes possible to provide the ink cartridge in which management of the waste ink can be appropriately performed.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiment of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

It should be noted that while the preferred embodiment will be discussed in terms of a printer employing a paper in a form of roll paper, in which a large number of labels are sequentially arranged on a released paper, as a printing medium, any type of printing medium in a form, a king and a material may be selected adapting the printer. For example, a cut paper may be employed as the printing medium. Also, as a material for the printing medium, film, cloth or any other material may be selected.

Also, while the discussion given hereinafter is concentrated for application of the present invention to a label printer, the printer according to the present invention may be applicable for printing mediums, such as perforated continuous paper, name card, card and so forth. In the alternative, the printer according to the present invention can be in a form of a ticket printer and so forth. In short, the present invention is applicable for wide variety of forms of printers.

Figure 1:
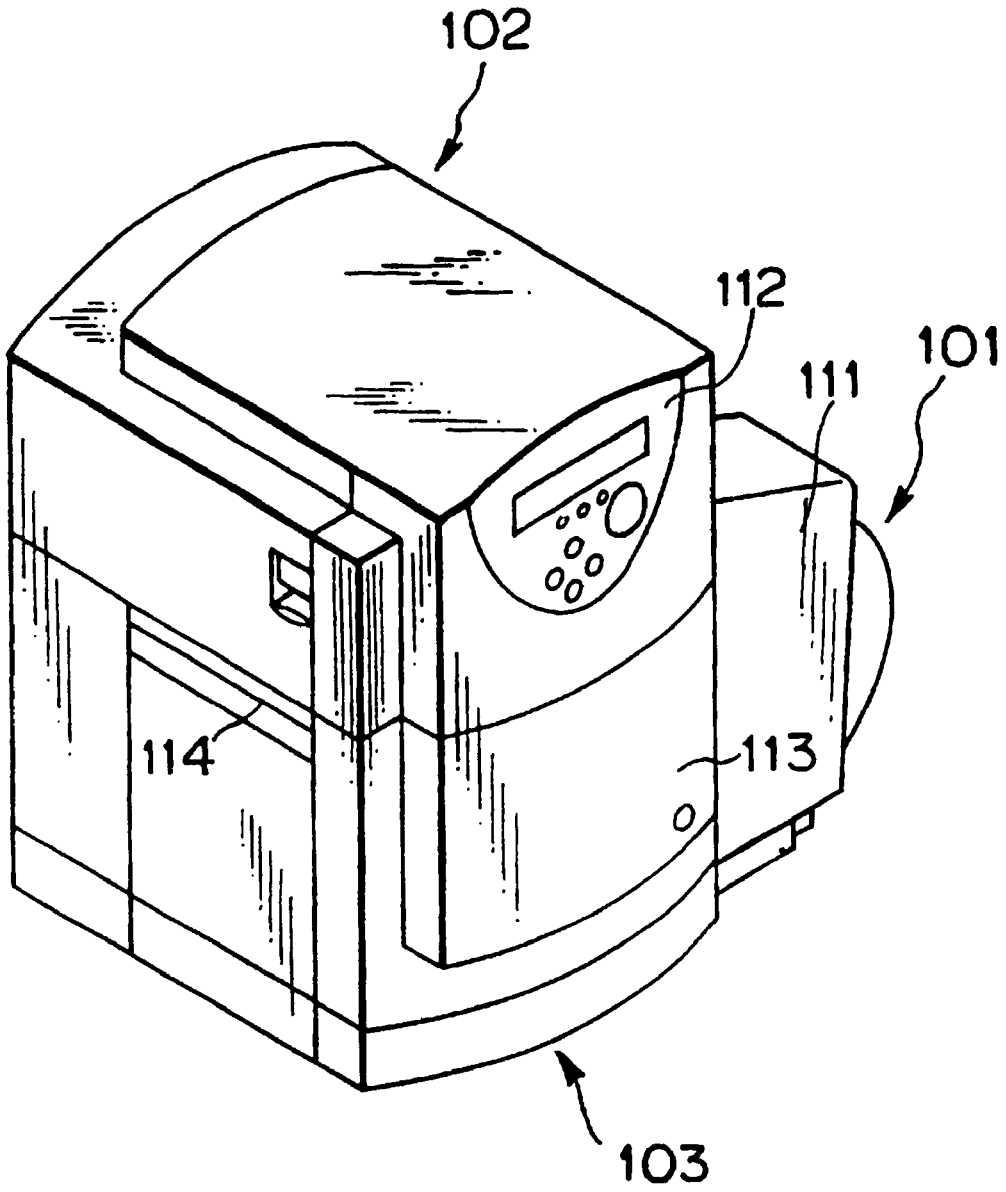
FIG. 1 is a perspective view showing external appearance of one embodiment of a label printer according to the present invention.

FIG. 1 is a perspective view showing an external appearance of one embodiment of a label printer according to the present invention.

The shown embodiment of the label printer employs a roll paper form paper, in which a plurality of labels are sequentially arranged on a released paper. The label printer generally comprises three pars, i.e. a roll paper supply unit 101, a printing head portion 102 and an ink cartridge receptacle portion 103. A cover 111 of the roll paper supply unit 101 is provided in detachable fashion. By this, new roll paper 124 can be set (see FIG. 2). The roll paper 124 to be stored in the roll paper supply unit 101 is, as discussed later with reference to FIG. 2, fed by a paper feeding mechanism formed between the printing head portion 102 and the ink cartridge receptacle portion 103. During feeding, printing is performed by a printing head in the printing head portion 102 and ejected out of the apparatus through an ejection opening 114. It should be appreciated that it is possible to connect a device for peeling off the label from the released paper ejected through the ejection opening 114. Also, it is possible to connect a device for taking up the label together with the released paper, on which the labels are adhered.

The printing head portion 102 is provided for pivoting about the rear end (in the drawing) serving as a pivot shaft with respect to the ink cartridge receptacle portion 103 for opening and closing. By this, it becomes possible to perform maintenance of the printing head of the printing head portion, the paper feeding mechanism and so forth and setting of the roll paper 124. At the front end portion of the printing head portion 102, an operating portion 112 including a lamp or liquid crystal indicator for indication of various condition of the label printer, and operating keys, is provided.

A front cover 103 of the ink cartridge receptacle portion 103 can be opened and closed about a pivot axis which is established at the left side end in the shown case. By this, upon exchanging of the ink cartridge, the ink cartridge can be unloaded and loaded by opening the front cover 113.

Figure 2:
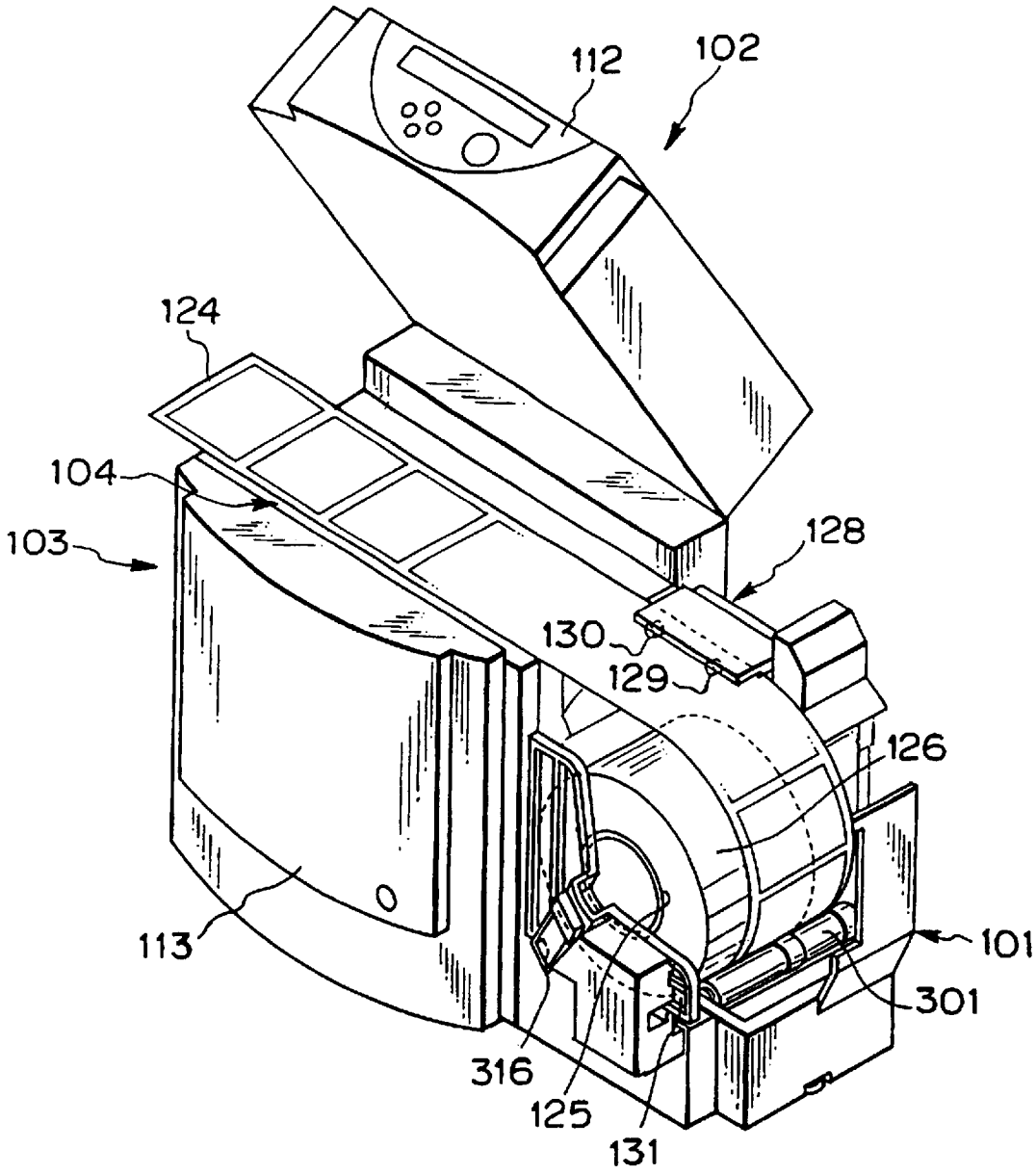
FIG. 2 is an exploded perspective view showing the label printer shown in FIG. 1 in a condition where a case cover is removed.
Figure 3:
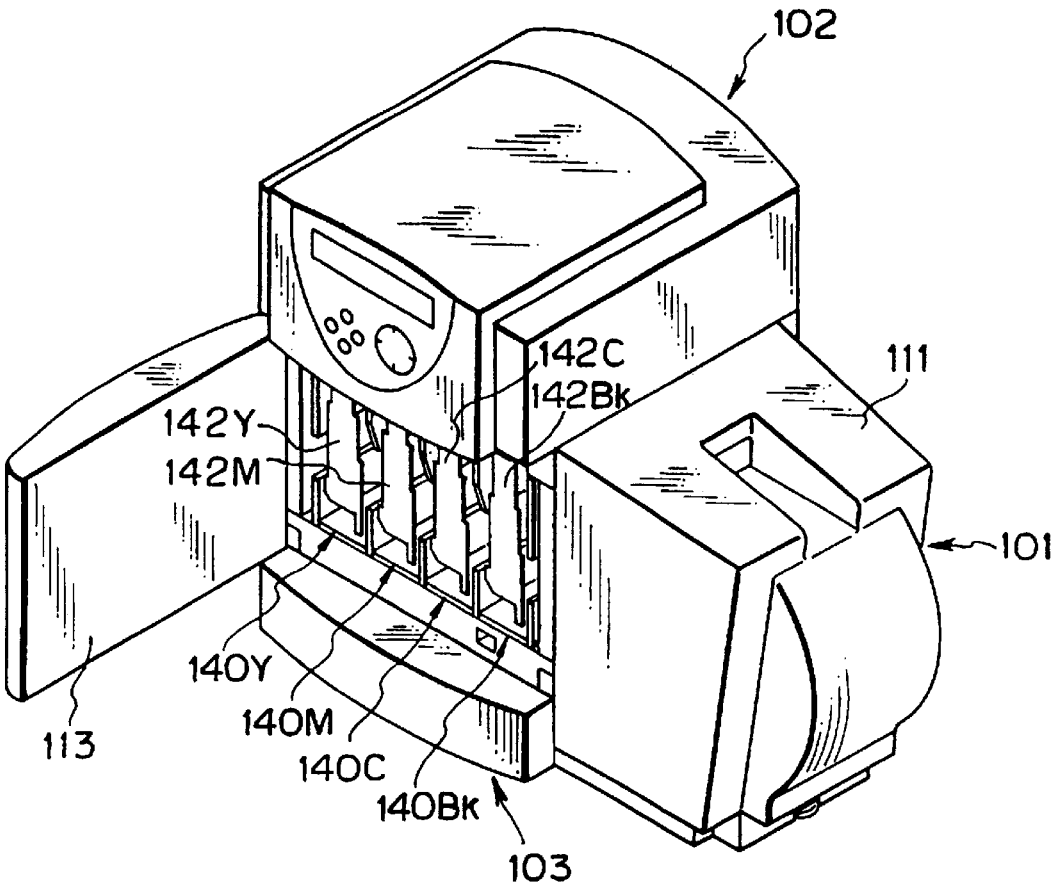
FIG. 3 is a perspective view of the label printer shown in FIG. 1 in a condition where a front cover is opened.

FIG. 2 is a perspective view of the label printer of FIG. 1, showing a condition where the cover 111 of the roll paper supply unit 101 is removed and the printing head portion 102 is pivoted upwardly to be situated in the open position. FIG. 3 is a perspective view of the label printer of FIG. 1, in which the front cover 113 of the ink cartridge receptacle portion 103 is held open.

As shown in FIG. 2, a roll 126 on which the roll paper 124 is wound and which is stored in the roll paper supply unit 101, is mounted on a pair of drive roller 301 (only one is shown). At this condition, the outer periphery of the roll 126 and the drive roller 301 are kept in contact under a pressure due to own weight of the roll paper 124. At this condition, by rotation of the drive roller 301 and so forth by a driving force of a not shown motor, the outermost roll paper 124 is separated from the remaining inner side roll paper 124 and fed into the label printer. Supply of the roll paper 124 performed in substantially irrespective of feeding by a roll paper feeding mechanism 104 (detail is not shown) located between the printing head portion 102 and the ink cartridge receptacle portion 103. Accordingly, for adjusting feeding between these two parts, in the supply of the roll paper 124, supply of the roll paper 124 is controlled to form a loop (not shown in FIG. 2) serving as a buffer. Namely, when a loop is not detected by a loop sensor (not shown) by feeding in the roll paper feeding mechanism 104, the drive roller 301 is driven to feed the roll paper 124 with forming the loop.

A paper guide 131 is provided for sliding in a width direction of the stored roll 126. Namely, upon storing the roll paper 124, the paper guide 131 is slide in a magnitude greater than the width of the roll paper 124 to place the roll 126 on the drive roller 301. Thereafter, the paper guide 131 is slide to the width of the roll 126 to contact a part thereof onto a core member 125 of the roll 126. By this, upon supplying of the roll paper 124, vibration of the roll paper 124 in the width direction at the upstream of the drive roller in the supply direction can be restricting by permitting constant fine vibration. It should be noted that, on the paper guide 131, a stopper 316 for fixing the slide position is provided.

In the feeding path of the roll paper 124, in the vicinity of the feeding path in the roll paper feeding mechanism 104, an obliquely feeding unit 128 is provided. The obliquely feeding unit 128 includes two obliquely feeding rollers (not shown) contacting with the lower surface of the roll paper 124 and obliquely feeding rolls 129 and 130 contacting with the upper surface of the roll paper 124. Two obliquely feeding rollers comprises drive roller opposing to the obliquely feeding roll 130 and driven by a driving force from the roll paper feeding mechanism 104, and driven roller opposing to the obliquely feeding roll 129 and not driven by the driving force. Respective of the driving roller and the driven roller rotate in oblique direction relative to the feeding direction of the roll paper 124 (a rotation axis also lies in oblique with respect to a direction perpendicular to the feeding direction). Also, the obliquely feeding rolls 129 and 130 are mounted in oblique to the feeding direction similarly to the obliquely feeding rollers. By these obliquely feeding rollers and the obliquely feeding rolls 129 and 130, a transporting force in an oblique direction is applied to the roll paper 124 to be fed to abut the roll paper 124 onto a predetermined guide in the distal side in the drawing. As a result, the roll paper 124 is applied a restricting force in a given direction in the feeding direction and thus can be fed stably without causing vibration in the feeding direction.

While it is neglected from illustration in FIG. 2, the roll paper feeding mechanism 104 disposed between the printing head portion 102 and the ink cartridge receptacle portion 103 is constructed with a plurality of belts arranged at the lower side of the roll paper 124 (thereafter arranged on the upper surface of the ink cartridge receptacle portion 103), rollers provided at upstream side and downstream side of the belt with respect to the feeding direction for driving the belts, and a wheel 141 (see FIG. 4) arranged at the lower surface of the printing head portion 102 and transmitted the driving force via the predetermined belt among the belts.

In FIG. 3, the ink cartridge receptacle portion 103 has four cartridge receptacle chambers 140Y, 140M, 140C and 140Bk corresponding to four kinds of inks, i.e. yellow (Y), Magenta (M), cyan (C) and black (Bk) inks. In the vicinity of the inlets of respective cartridge receptacle chambers 140Y, 140M, 140C and 140Bk, shutters 142Y, 142M, 142C and 142Bk substantially shielding inside of the cartridge receptacle chambers 140Y, 140M, 140C and 140Bk. The shutters 142Y, 142M, 142C and 142Bk are pivotably supported at the upper portion so as to avoid erroneous insertion of the user's hand into the inside of the cartridge receptacle chambers 140Y, 140M, 140C and 140Bk and erroneous contact to the ink supply needles. Upon insertion of the ink cartridge, insertion of the ink cartridge is performed by orienting the ink cartridge per se toward the distal side to open the shutter.

Figure 4:
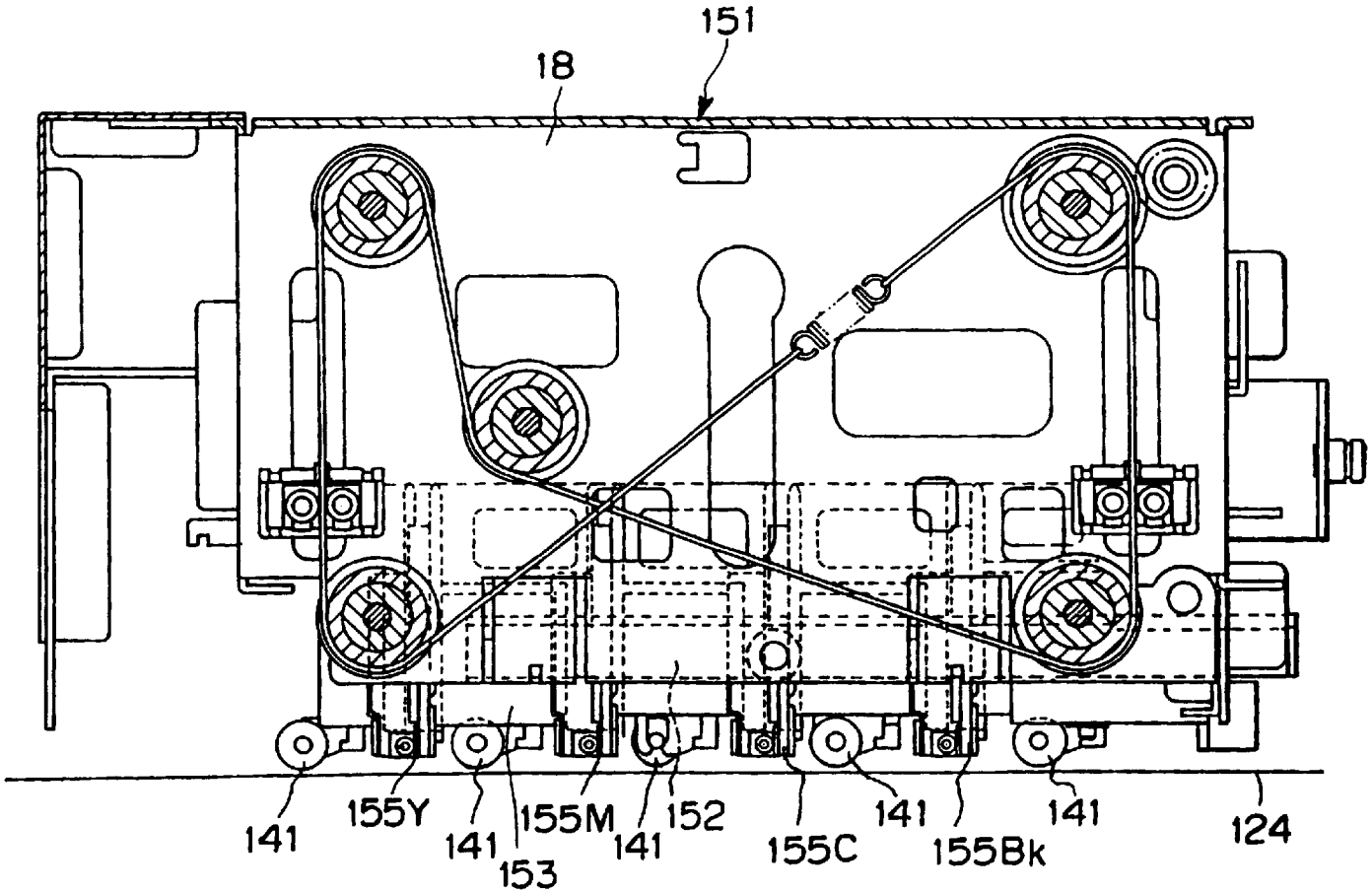
FIG. 4 is a section showing a mechanism of a print head station of the label printer of FIG. 1.

FIG. 4 is a front elevation showing a construction of a printing head station 151 (hereinafter referred to as "PHS"), as primary mechanism of the printing head portion 102.

The PHS 151 has ink-jet heads 155Y, 155M, 155C and 155Bk having ejection openings arranged beyond overall width of the label in the width direction of the roll paper 124 for performing printing with respect to the label arranged on the roll paper 124. As these heads 155Y, 155M, 155C and 155Bk, the ink-jet heads employing so-called bubble-jet system having elements generating thermal energy by generating film boiling of ink as energy utilized for ejection of the ink, are employed. Also, the PHS 151 has an ink collection means for collecting ink ejected through ink ejection openings arranged in respective of the heads 155Y, 155M, 155C and 155Bk, a blade for sweeping and removing residual ink on an ejection opening forming surface in the vicinity of the ink ejection openings of the heads 155Y, 155M, 155C and 155Bk, and a recovery system unit 153 having a cap preventing drying in the vicinity of the ink ejection openings.

In the PHS 151, a drive system unit for shifting the head holder unit 152 supporting the heads 155Y, 155M, 155C and 155Bk in the perpendicular direction from the printing position with respect to the roll paper 124 and shifting the recovery type unit 153 for a given magnitude in horizontal direction along the feeding direction of the roll paper 124, and a cooling unit for cooling the heads 155Y, 155M, 155C and 155Bk are provided.

On the lower portion of the PHS 151, wheels 141 are provided at both sides of respective heads 155Y, 155M, 155C and 155Bk are provided, as set forth above.

It should be noted that, while the discussion is given with generally dividing the label printer into three portions as set forth above, it is manner of course that not only the disclosed elements or mechanisms but also other elements and mechanisms are provided in respective portions. Discussion for other elements associated with the disclosed elements, control board, drive, motor, ink supply system and so forth may be arranged appropriately. For the elements and mechanisms other than those disclosed in the foregoing discussion will be constructed with known elements and mechanisms.

Figure 5:
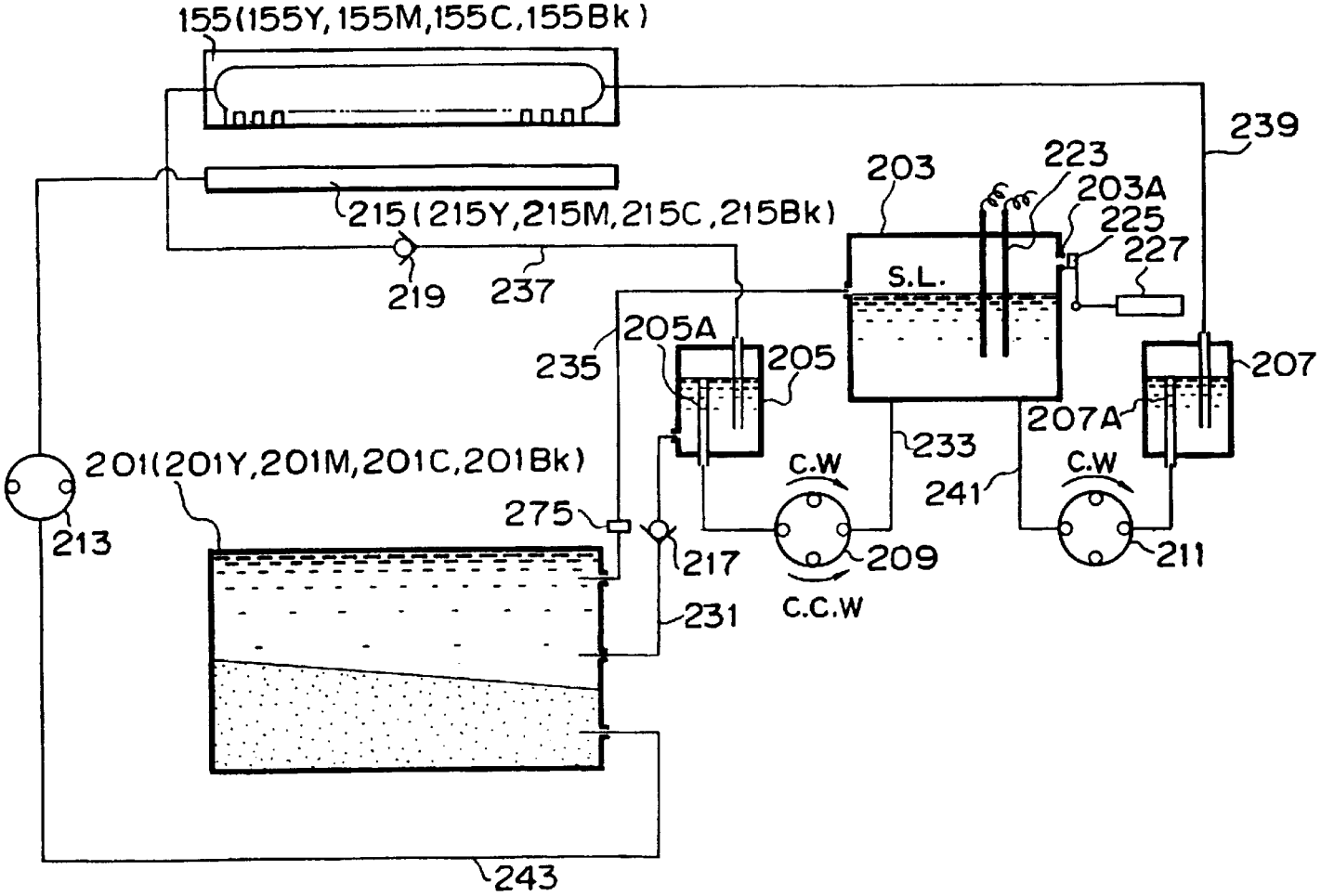
FIG. 5 is a diagrammatic illustration showing an ink supply system in the label printer.

FIG. 5 is a diagrammatic illustration showing an ink supply system provided in the label printer set forth above.

The shown embodiment of the ink supply system has ink storage chambers 203 having ink cartridges 201 and an ink-jet heads 155 for respective colors, a plurality of buffer means 205 and 207. The ink supply in this system is performed by a pressure difference between tube pumps 209 and 211 and meniscus difference between respective elements. It should be noted that the ink storage chamber 203, the plurality of buffer means 205 and 207, tube pumps 209 and 211 and so forth shown in FIG. 5 are provided for each ink similarly to the ink-jet head 155, the ink cartridge 201, an ink receptacle 215. Namely, the ink supply system shown in FIG. 5 is provided for each color of ink.

Discussion will be given hereinafter with respect to major ink supply modes in the shown embodiment of the ink supply system.

At first, discussion will be given for a mode for maintaining the liquid level of the ink storage chamber 203 at reference liquid level S. L. by supplying ink from the ink cartridge 201 to the ink storage chamber 203. In this mode, a solenoid 227 is driven to close the atmosphere communication opening 203A of the ink storage chamber 203 by a plug 225. On the other hand, by the roller of the tube pump 211, a tube 241 is crushed for closing. At this condition, the tube pump 209 is driven in counterclockwise direction (C.C.W.) to introduce a vacuum into the buffer tank 205. At this time, by an one-way valve 219, ink does not flow into a supply path 237 from the head 155. On the other hand, ink flows into the buffer tank only from the ink cartridge through the supply path 231, in which an one-way valve 217 is in forward direction. When an ink level reaches a tube 205A in the buffer tank 205 by introduction of the ink, the ink flows into the ink storage chamber 203 via the supply passage 233. By introduction of the ink, when the ink level in the ink storage chamber 203 reaches the reference liquid level S.L., the excessive ink by further flow of the ink flows into the ink cartridge 201 via the supply path 235 to maintain the reference liquid level S.L.

Namely, this ink supply mode is performed by driving the tube pump 209 for a given period at an appropriate timing other than the period of printing operation, in which ink is ejected from the head 155. Thus, a printer control portion can maintain the reference liquid level S.L. in the ink storage chamber 203 only by controlling the drive timing and driving period. The reference liquid level S.L. is held in a range of appropriate meniscus level with respect to the head to appropriately perform ink supply upon ejection of ink.

It should be noted that a sensor 223 provided in the ink storage chamber 203 is for detecting presence and absence of the ink and is used for detecting spent out of the ink in the cartridge tank 201 when sensor 223 does not detect presence of the ink even after driving of the tube pump 209 for a given period.

Next, discussion will be given for a supply mode upon ejection of ink in the ink-jet head.

In this mode, the atmosphere communication opening 203A of the ink storage chamber 203 is held in open condition, and the tube pump 209 and 211 are held uncrushed, i.e. in through condition. When ejection is performed buy the ink-jet head at this condition, the ink of the ink storage chamber 203 is supplied to the ink-jet head 155 via two systems of supply paths 233, 237 and 241, 239 due to meniscus difference between the ink storage chamber 203 and the head 155.

The third to be discussed is a supply mode in recirculation of ink to be performed as one of ejection recovery process of the ink-jet head 155. In this mode, the atmosphere communication opening 203A of the ink storage chamber 203 is held open and two tube pumps 209 and 211 are driven to rotate in the clockwise direction (C.W. direction). By this, the ink flows into the head 155 via the supply paths 233 and 237 from the ink storage chamber 203, and in conjunction therewith, the ink flows into the ink storage chamber 203 from the head 155 via the supply paths 239 and 241. By such recirculation if the ink, the bubble residing within the head 155 can be collected within the ink storage chamber 203 together with the ink and finally discharge to the atmosphere via the atmosphere communication opening 203A.

On the other hand, upon recirculation of the ink as set forth above, the pressure in the head 155 is desired to be maintained at a level slightly higher than the atmospheric pressure. By this, leakage of the ink via the ink ejection opening during recirculation can be minimized. However, in the ink supply system of the shown embodiment, pulsation of the pressure is large since the tube pump 209 is employed as a supply power source and synchronization control between two tube pumps 209 and 211 is not performed, pulsation in the head 155 during recirculation becomes further greater in magnitude.

Therefore, in the shown embodiment, by providing the plurality of buffer means 205 and 207 between the head 155 and the tube pumps 209 and 211, pulsation of the tube pumps 209 and 211 is absorbed by these a plurality of buffer means 205 and 207. Therefore, during recirculation of the ink, the pressure within the head 155 can be maintained at constant value in the appropriate level.

Further ink supply mode is a supply mode during pressurizing recovery to be performed as one of ejection recovery process similarly to the foregoing mode. In this mode, the atmosphere communication opening 203A is held open and the tube pump 211 is held in the condition where the tube 241 is crushed by the roller. When the tube pump 209 is driven in the clockwise direction (C.W direction) at this condition, the ink is supplied to the head from the ink storage chamber 203 via the supply paths 233 and 237. The supply pressure at this time is higher than that in recirculation if ink since the tube pump 211 is held inoperative. Therefore, the ink in the head 155 is ejected to the ink receptacle 215 via the ejection opening. Associating with ejection of the ink, high viscous ink within the head 155 can be ejected.

The ink within the ink receptacle portion 215 receiving the ejected ink by preparatory ejection performed as one of ejection recovery processes, is introduced into the waste ink storage portion of the ink cartridge 201 via the supply path 243 by a tube pump 213.

Figure 6:
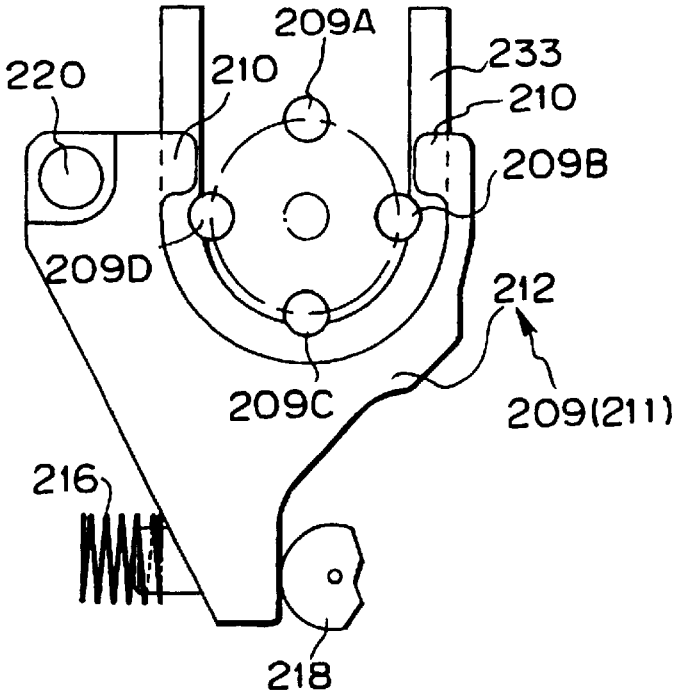
FIG. 6 is a front elevation showing a general construction of the shown embodiment of a tube pump to be employed in the ink supply system.
Figure 7:
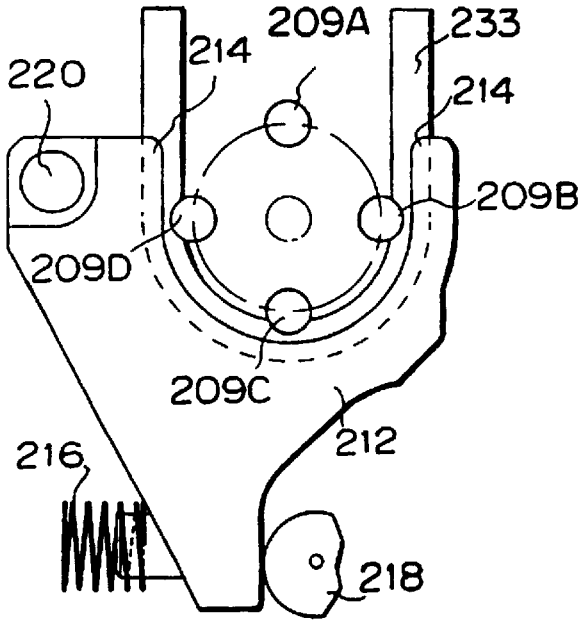
FIG. 7 is a front elevation showing a general constriction of the conventional tube pump to be employed in the ink supply system.

FIG. 6 is a front elevation showing a detail of the tube pump 209 (211) to be employed in the ink supply system of FIG. 5, and FIG. 7 is a similar illustration showing the tube pump in the prior art.

As shown in FIG. 6, the shown embodiment of the tube pump 209 is formed with a semicircular recess is a tube holder 212 which forms a support member. Along the semicircular portion, the tube 233 is arranged. At a position offset from the center of the semicircular, a roller rotating portion having a rotary axis is arranged. In the roller rotating portion, depression rollers 209A, 209B, 209C and 209D are provided (other elements are not necessary to be illustrated). By rotation of the roller rotating portion, respective depression rollers 209A, 209B, 209C and 209D pushes the tube 233 to place the tube 233 in crushed position in a range of 65 in back and force direction at the lowermost position in the drawing.

On the other hand, the tube holder 212 is pushed by means of a spring 216 to be held in the condition illustrated in FIG. 6. However, while the tube 233 is not depressed and thus in the through condition, it drives the cam 218 to rotate to pivot the tube holder 212 toward left in the drawing about an axis 220.

Here, the difference between the shown embodiment of the tube pump 209 (see FIG. 6) and the conventional tube pump (see FIG. 7) is that, in the conventional tube pump, a tube guide 214 is provided in the overall length for the portion of the tube 233 extending along the semicircular portion. In contrast to this, in the shown embodiment, the guide 210 is provided. only portion except for the semicircular portion. (The guide 210 is also provided symmetrically on the back side relative to the tube, in the drawing.)

With the construction of the guide in the shown embodiment, the guide restricts the tube 233 at the portions in the vicinity of the depressing portion other than the portion where the tube is crushed by the depression rollers 209A to 209D. In contrast to this, in the prior art shown in FIG. 7, the overall tube 233 including the portion to be depressed is guided. Therefore, when the tube 233 rides over the guide in certain cause, it becomes possible that the tube 233 is cut off by the depression roller.

Thus, according to the shown embodiment, since the guide is not present at the portion where the depression rollers 209A to 209D act, the possibility of cutting of the tube 233 can be successfully avoided even when large magnitude of offset is caused in the tube 233.

Figure 8:
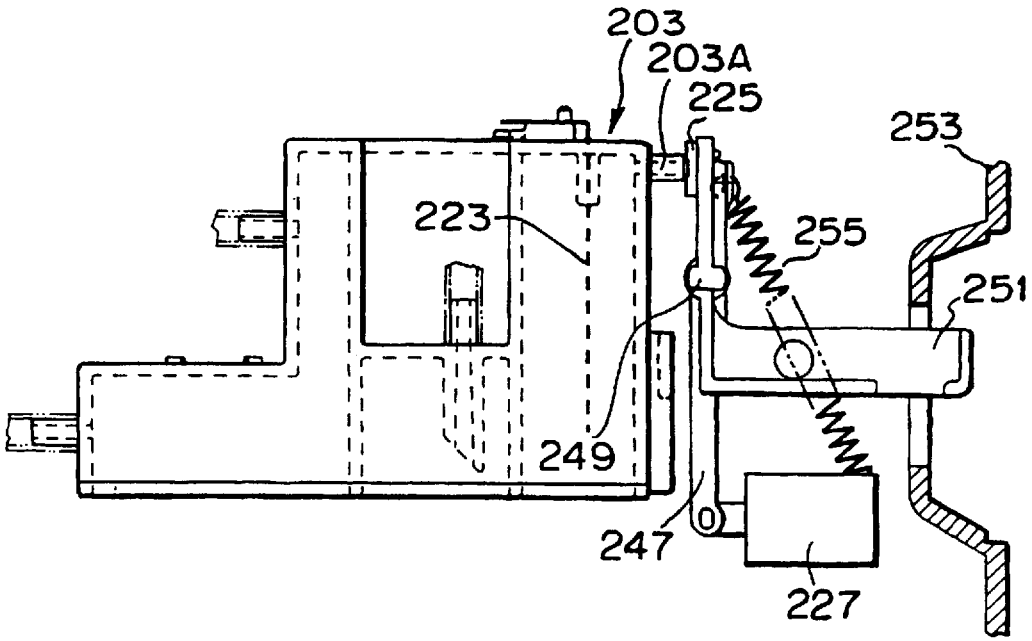
FIG. 8 is a front elevation showing a ink storage chamber and an opening and closing mechanism of an atmosphere communication opening of the ink storage chamber.
Figure 9:
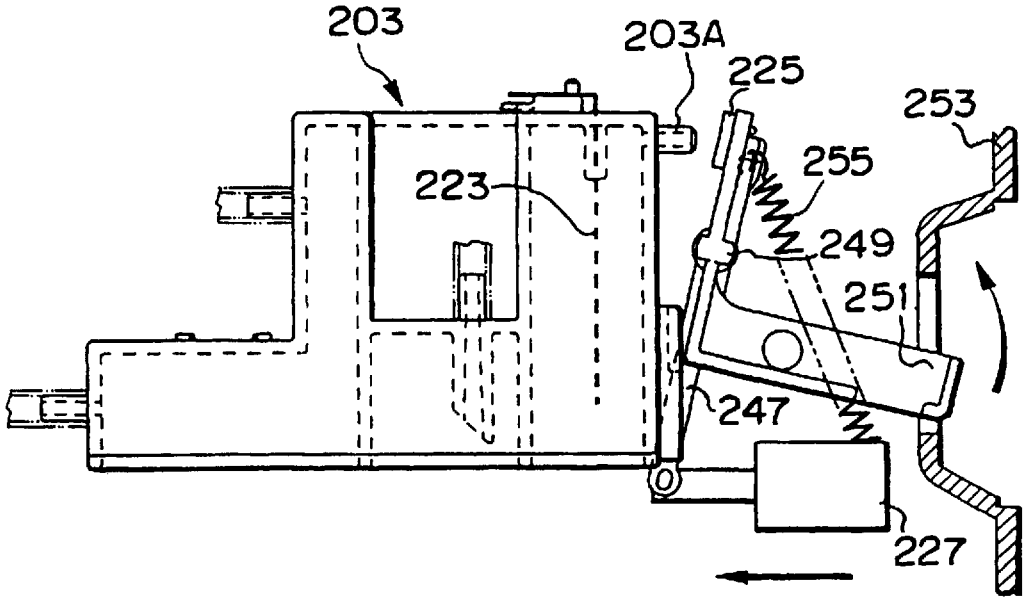
FIG. 9 is a front elevation showing the ink storage chamber shown in FIG. 8 in a condition where the atmosphere communication opening is opened.

FIGS. 8 and 9 are front elevations showing the detailed configuration of the ink storage chamber 203 shown in FIG. 5 and the opening mechanism of the atmosphere communication opening 203A. FIG. 8 shows the closed condition of the atmosphere communication opening 203A and FIG. 9 shows the open condition thereof.

The opening mechanism for the atmosphere communication opening 20A is constructed as follow. A seal lever 247 is pivotably supported by a support shaft 249. The plug 225 for contacting with the opening end of the atmosphere communication opening 203A is carried at one end of the seal lever 247. The other end of the seal lever 247 is connected to a plunger of a solenoid 227 for pivotal movement therewith. Here, the solenoid 227 is so-called latch solenoid which can maintain the plunger in place when no power is supplied and is placed at a given position. On the other hand, the seal lever 247 is connected to a tension spring 255 in the vicinity of the portion where the plug 225 is provided. The other end of the spring 255 is connected to a casing member holding the solenoid 227. Also, the seal lever 247 is integrally formed with an operation lever 251.

In the opening and closing mechanism as set forth above, as shown in FIG. 5, power supply for the solenoid 227 is controlled depending upon respective ink supply modes to operate the actuating member. In conjunction therewith, by the action of the spring 255, the seal lever 247 is pivoted. By this, the plug 225 contacts and released from the opening end of the atmosphere communication opening 203A to open and close the atmosphere communication opening 203A.

In addition to the opening and closing mechanism as set forth above, upon transportation for shipping of the label printer or moving of the installation position of the printer, the operation lever 251 is operated as shown by arrow in FIG. 9 to establish closed position shown in FIG. 8. By this, even when the label printer subjects vibration during transportation, moving or so forth, ink will never leak through the atmosphere communication opening 203A.

Figure 10:
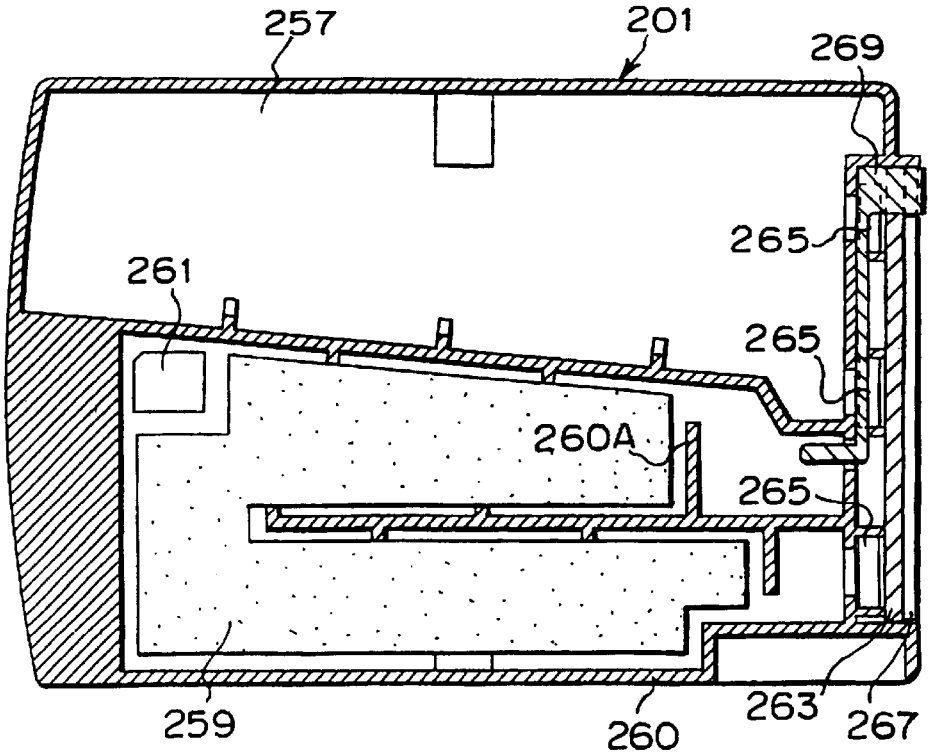
FIG. 10 is a section showing an internal structure of an ink cartridge.
Figure 11:
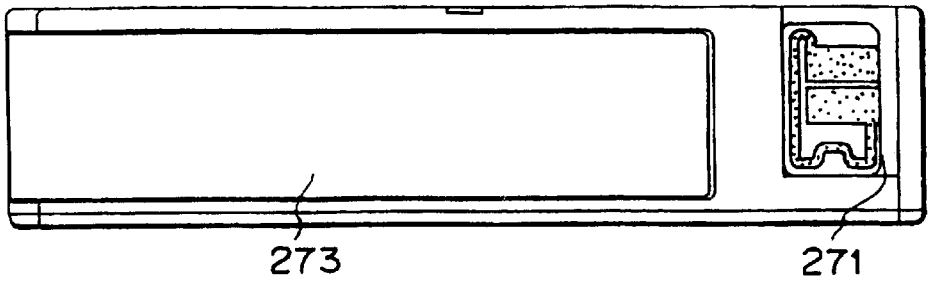
FIG. 11 is a plan view of the ink cartridge shown in FIG. 10.
Figure 12:
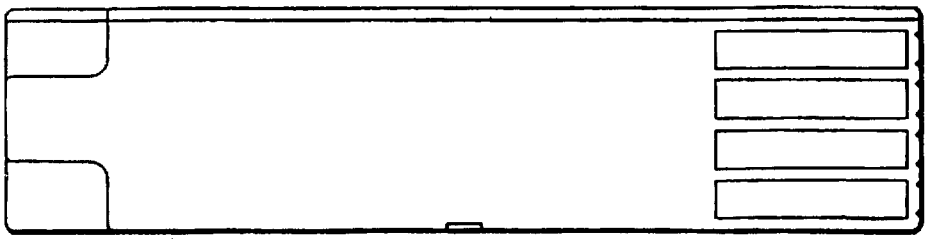
FIG. 12 is a bottom view of the ink cartridge of FIG. 10.

FIG. 10 is a section of the side showing the internal structure of the ink cartridge illustrated in FIG. 5, FIG. 11 is a plan view and FIG. 12 is a bottom view of the ink cartridge.

As shown in these drawings, the ink cartridge 201 includes an ink storage chamber 257 and a waste ink storage chamber 260. At the end of the ink storage chamber, rubber plugs 265 are provided at two portions for passing ink supply needles 275 which will be discussed later. These rubber plugs 265 have a construction sandwiches by the case member of the ink cartridge, an ink absorbing member 263 and a rubber plug holder 267 except for the portions where needles 275C and 279C pass through. With this construction, when the ink cartridge is removed from the label printer, the ink adhering on the supply needles 275C and 279C drawn out of the ink cartridge can be removed by the ink absorbing member 263. Therefore, it can prevent contamination of the inside of the label printer by the ink adhering on the supply needles 275C and 279C and plugging of the supply nozzles 275C and 279C per se.

The waste ink storage chamber 260 is formed with a two stages of storage portions communicated at one ends. A portion, in which the ink supply needle 279C passes through is provided corresponding to the lower stage storage portion. Namely, in the waste storage chamber 260, the ink supply needle 279C connected to the supply path 243 as illustrated in FIG. 5 passes through. By this, the waste ink discharged in the ejection recovery process and so forth flows into the lower stage portion of the ink storage chamber 260. Generally, in the whole body of the ink storage chamber 260 is filled with an ink absorbing member 259. Thus, the waste ink flowing into the lower stage storage portion of the water storage chamber 260 is absorbed by the ink absorbing member 259. According to introduction of the waste ink, the region of holding the waste ink among the waste ink gradually extends to the ink absorbing member 259 to partly exude out of the ink absorbing member. On the other hand, adjacent to the end of the waste ink absorbing member 259, a partitioning wall 261A is provided. By this, before the waster ink amount exceeds the holding capacity of the ink absorbing member 259, the exuded ink as set forth above is prevented from moving to the portion at the right side where the ink absorbing member 259 is not filled. Accumulatively, the waste ink among introduced tends to be increased to exceed the holding capacity of the ink absorbing member 259, Then, the exuded waste ink is then transferred to cause overflow to elevate the liquid lever, When the increased level fills up the wasted in the waste ink storage chamber 260 can be detected. Thus, it becomes possible to promote exchanging of the ink cartridge 201.

The inside of the waste ink storage chamber 260 is adapted to communicate with the outside via a Microtext (tradename: Nitto Denko K.K.) disposed therebetween. By this, leakage of the waste ink can be prevented, and in conjunction therewith, evaporation of the moisture content in the waste ink becomes possible.

On the upper surface of the ink cartridge 201, an identification seal 273 is adhered for identifying the kind of the ink stored therein. Also, at the front end of the ink cartridge 201, a resistant seal 271 for electrical detection of loading of the ink cartridge 201 and the kind of ink, is adhered.

Figure 13:
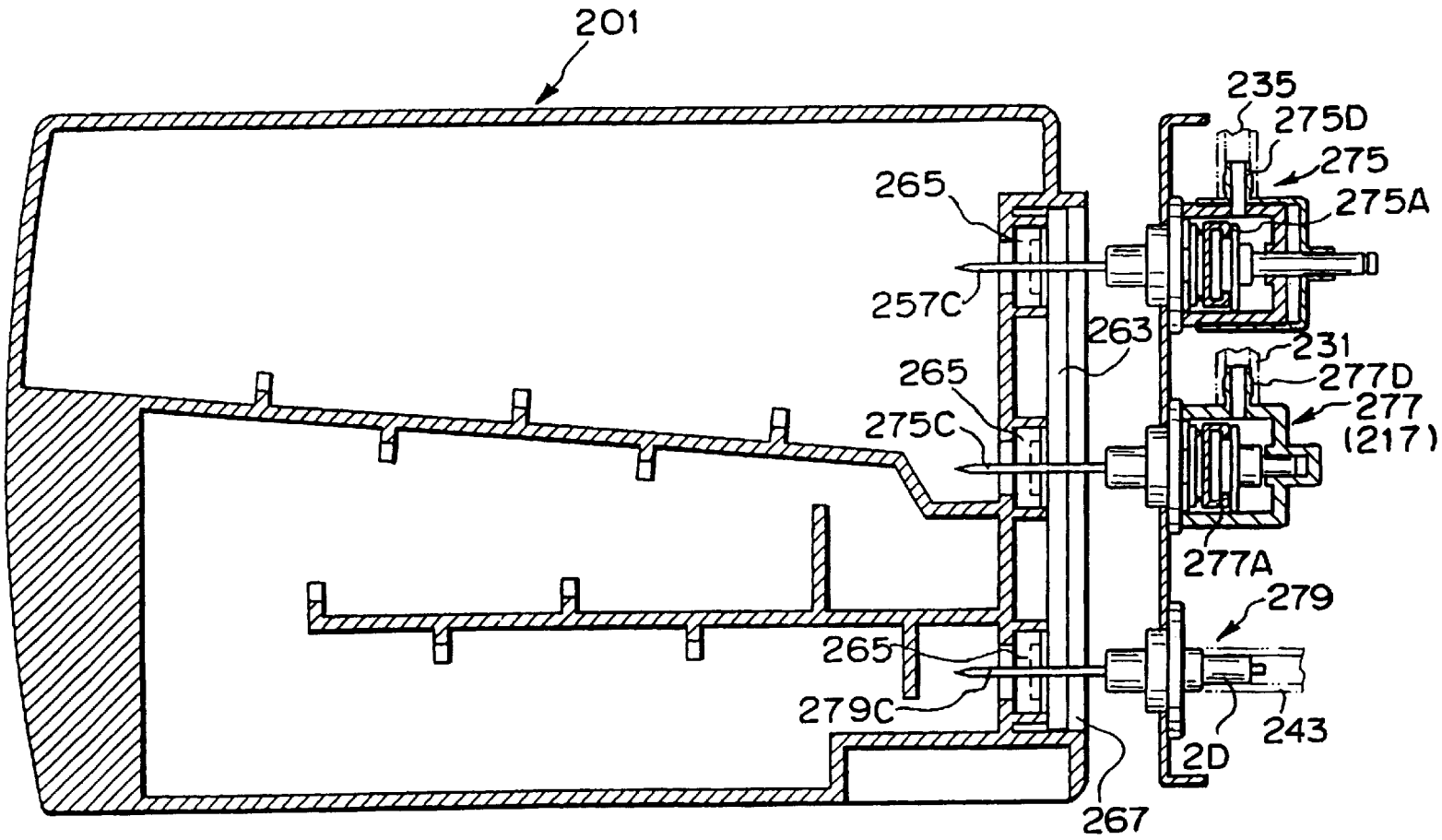
FIG. 13 is a conceptual illustration showing a relationship between the ink cartridge shown in FIG. 10 and an ink supply needle unit.

FIG. 13 is an illustration showing a loading condition of the ink cartridge 201 to the label printer. Namely, FIG. 13 shows the condition where respective ink supply needles 275C pierce the rubber plug 265 of the ink cartridge 201.

The supply needle unit 275 shown in FIG. 13 is connected to the supply path 235 (see FIG. 5) for recirculating the ink from the ink storage chamber 203. When the ink cartridge 201 is not loaded, the valve 275A is biased by means of a spring (not shown) toward left in the drawing to block communication between a connection tube 275D and the needle 275C. When the ink cartridge 201 is loaded, by an action of a not shown lever upon loading operation of the ink cartridge which will be discussed with reference to FIG. 20 and so forth, the valve 275A is opened against the spring force to establish communication between the connection tube 275D and the needle 275C.

Figure 14:
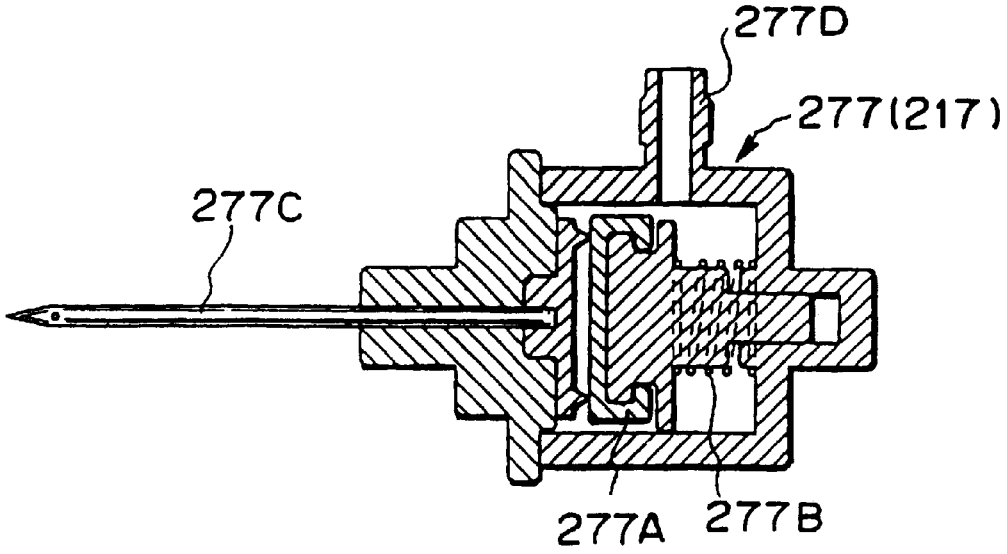
FIG. 14 is an enlarged section showing a structure of the ink supply needle unit.

A supply needle unit 277 is adapted to be connected to the supply path 231 (see FIG. 5) for supplying ink to the buffer tank 206 (see FIG. 5). Irrespective of loading or unloading condition of the ink cartridge 201, a valve 277A is normally biased toward left by a spring 277B to block communication between a connection tube 277D and the needle 277C, as shown in FIG. 14.

Figure 15:
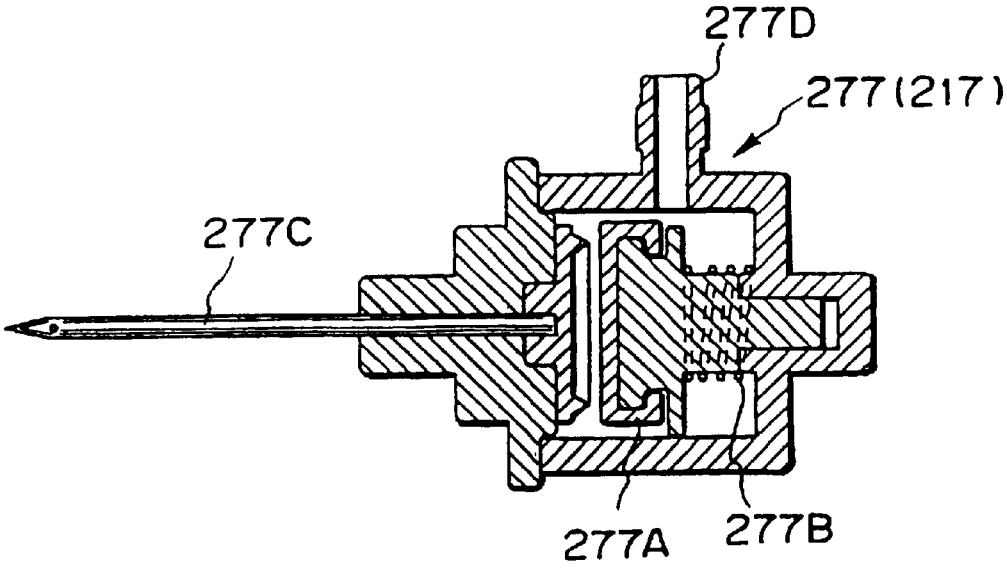
FIG. 15 is a section showing an operating condition of the ink supply needle unit of FIG. 14 in an ink supply mode.

The supply needle unit 277 establishes the communication between the connection tube 277D and the needle 277C in the following condition. As discussed with respect to FIG. 5, when the tube pump 209 is driven in counterclockwise direction in the ink supply mode to the ink storage chamber 203, vacuum is introduced into the connection tube 277D via the buffer tank 205. By this, as shown in FIG. 15, the valve 277A is shifted toward right against the biasing force of the spring 277B to establish communication between the connection tube 277D and the needle 277C. Then, the ink in the ink cartridge 201 is supplied to the buffer tank 205. Thus, the supply needle unit 277 serves to perform function of the check valve 217 shown in FIG. 5.

A supply needle unit 279 is connected to the supply path 243 (see FIG. 5) for the waste ink, in which a connection tube 279D and a needle 279C are constantly communicated with each other.

Figure 16:
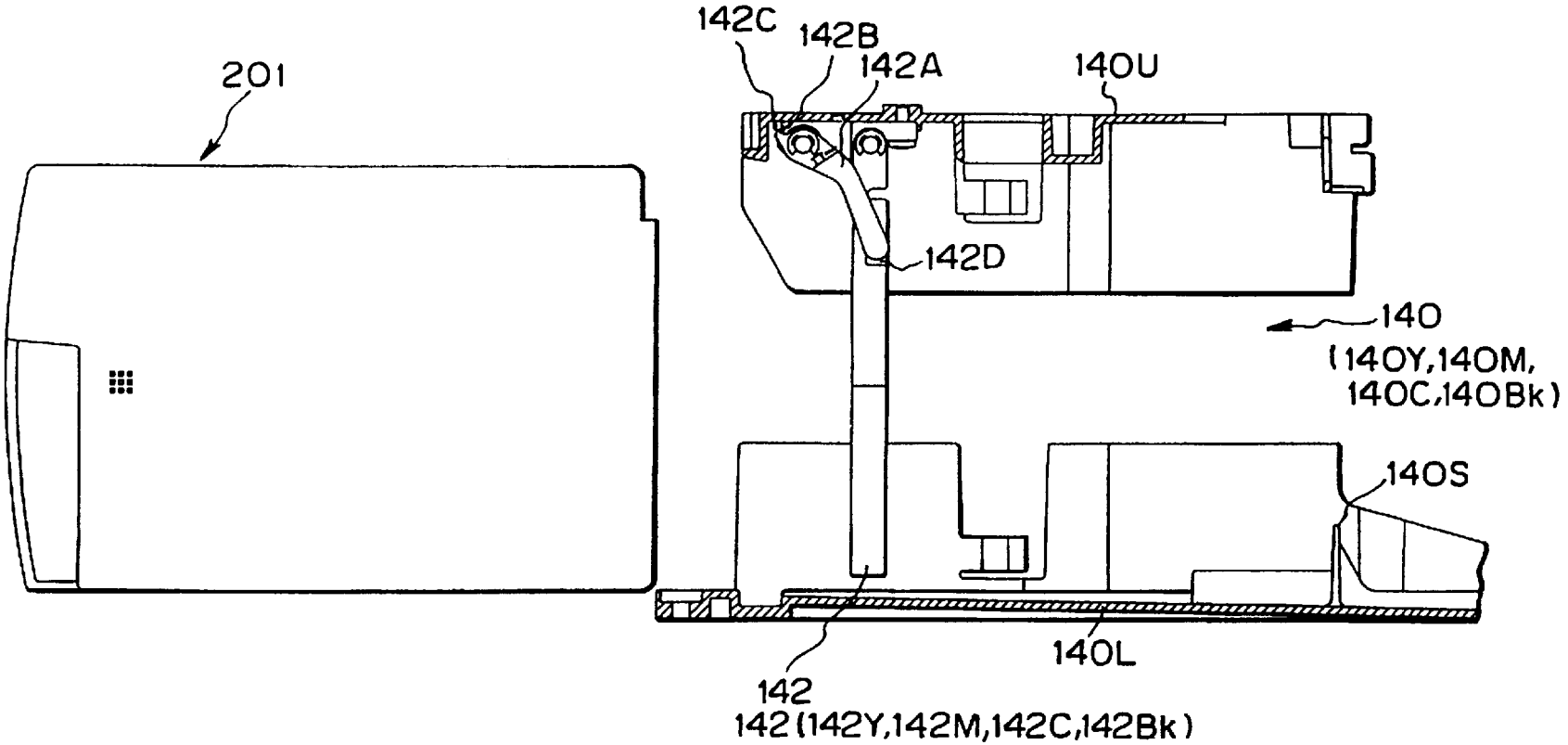
FIG. 16 is a section in a condition where the ink cartridge is removed.
Figure 17:
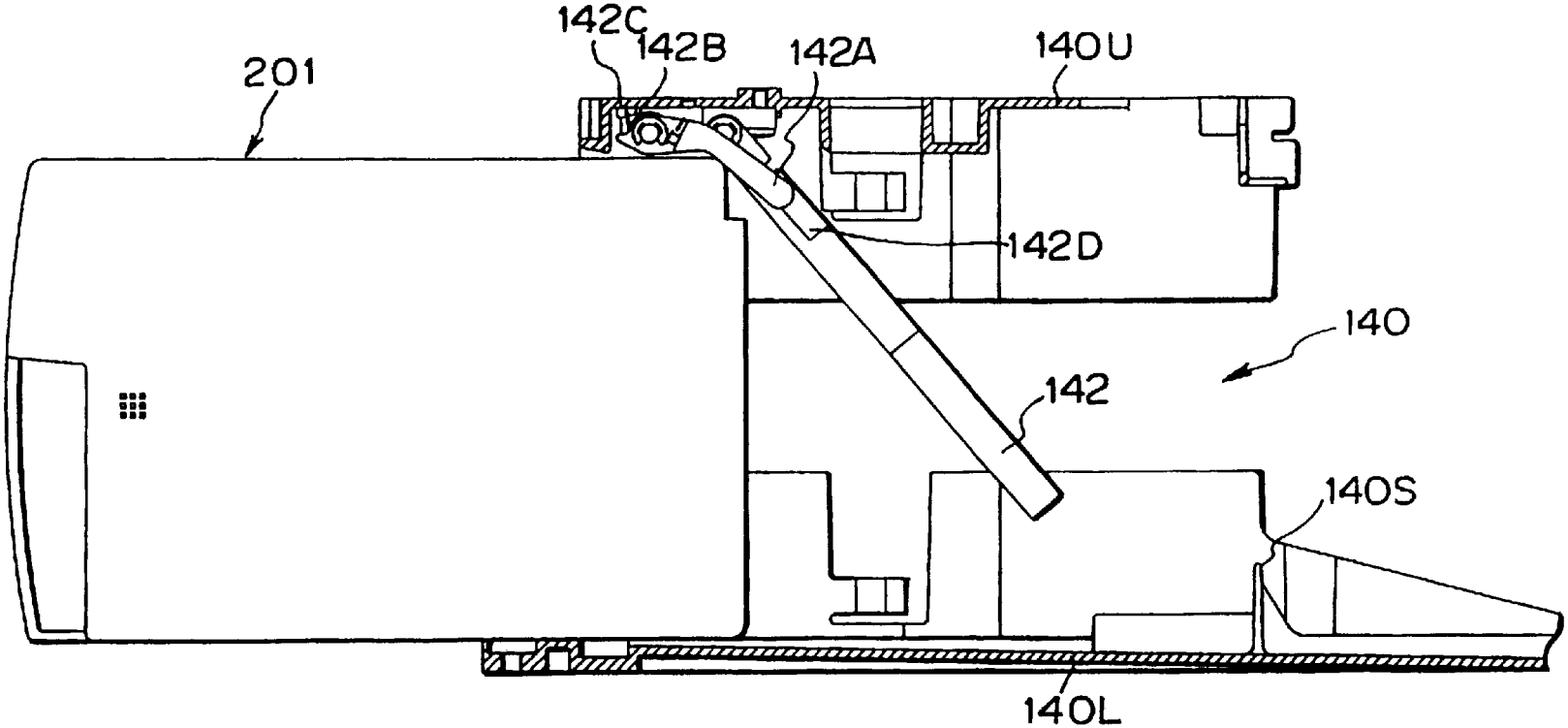
FIG. 17 is a section showing an intermediate position in detaching of the ink cartridge.
Figure 18:
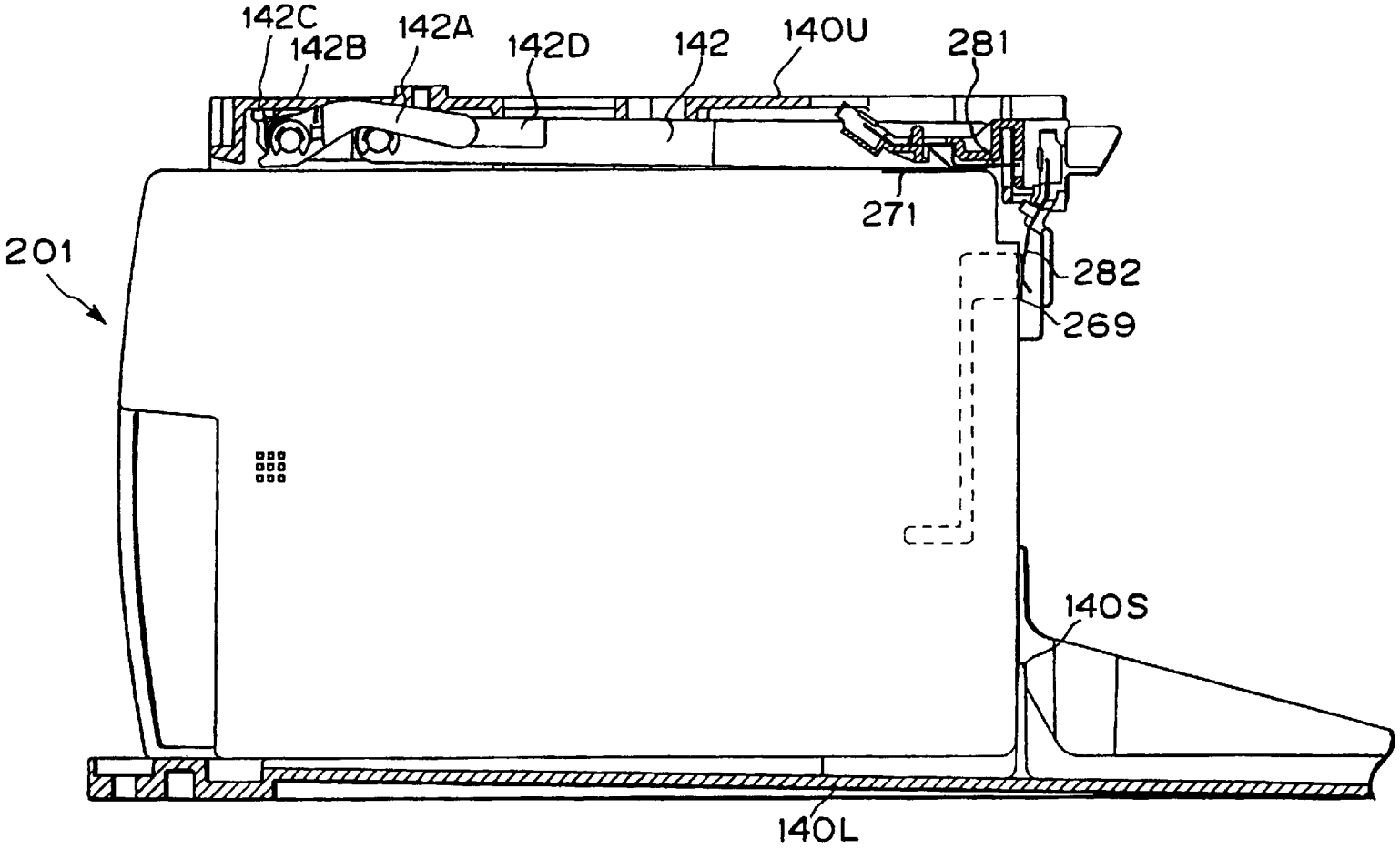
FIG. 18 is a section showing a condition where the ink cartridge is loaded.

FIGS. 16 to 18 are illustration showing detailed construction of the shutter 142 of the cartridge receptacle chamber 140 discussed with respect to FIG. 3 and loading operation of the ink cartridge 201 to the cartridge receptacle chamber 140.

As shown in FIGS. 16 to 18, the shutter 142 is pivoted at a predetermined position on an upper frame 140U of the cartridge receptacle chamber 140 and slidably engaged with a stopper lever 142A for sliding movement within a given range. On the other hand, the stopper lever 142A is similarly pivoted at a point frontwardly shifted from the pivot point of the shutter 142. The stopper lever 142A is restricted frontward pivoting range by a stopper 142C. With the construction set forth above, the shutter 142 is prevented from opening by pulling it frontwardly.

Upon insertion of the ink cartridge 201, as shown in FIG. 17, the ink cartridge 201 is pushed into the ink cartridge receptacle chamber with abutting the front end shoulder thereof with the stopper lever 142A, By this, the ink cartridge 201 finally abut to a stopper 140S provided on a lower frame 140L of the cartridge receptacle chamber 140 and thus is placed at the loading position shown in FIG. 18. At the loading position, the resistant seal 271 provided on the upper surface of the ink cartridge 201 comes into contact with an electrode 281 at the side of the main body and an electrode 269 for detection of the waste ink also contacts with an electrode 282 at the side of the main body. At this time, since the most part of the tip end portion of the shutter 142 is cut out as shown in FIG. 3, the shutter 142 is prevented from contacting with the resistant seal 271.

Figure 19:
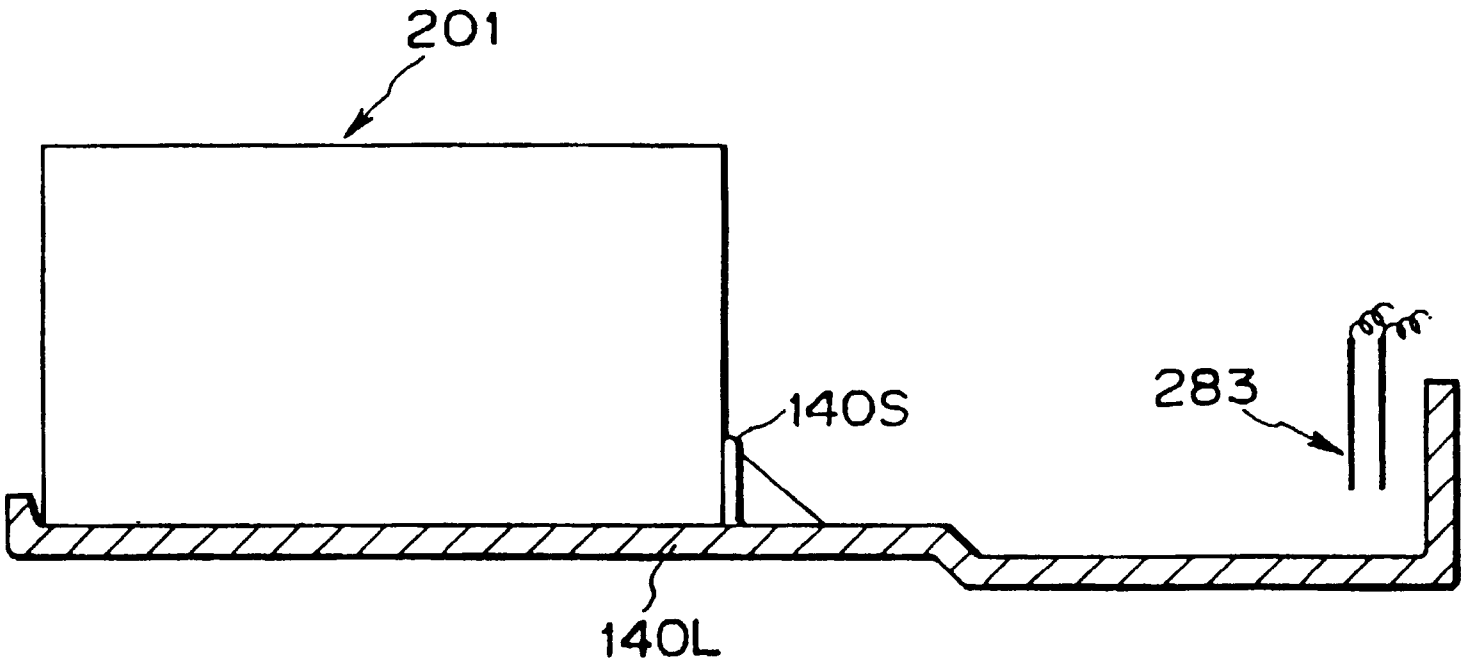
FIG. 19 is a section showing a structure of an under case frame in an ink cartridge receptacle chamber.

FIG. 19 is a diagrammatic longitudinal section showing the entire construction of the lower frame 140L of the cartridge receptacle chamber 140 set forth above.

The lower frame 140L is formed into tub-shaped configuration to accommodate therein the cartridge receptacle chamber 140 and other ink supply systems shown in FIG. 5. With such construction, even when leakage of ink is cased in the ink supply system, the ink will not flow out of the lower frame 140L. Furthermore, the lower frame 140L is inclined toward the rear side (right side in FIG. 19) and a sensor 283 for detecting the ink accumulated in the lower frame 140L is provided in the vicinity of the lowermost position of the lower frame. By this, presence of a given amount of leaked ink can be detected.

Figure 20:
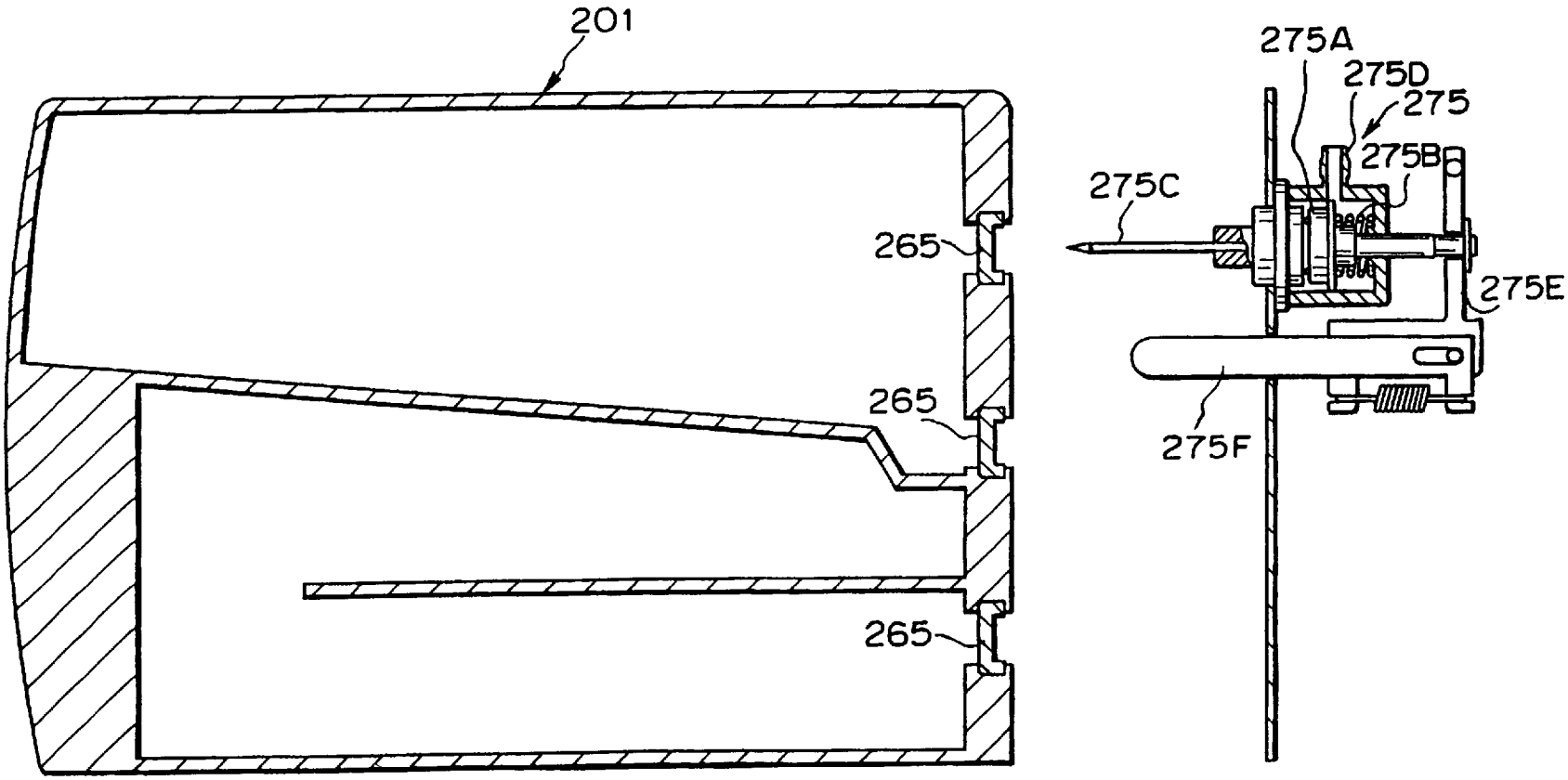
FIG. 20 is an exploded section, in which the ink cartridge and the ink supply needle unit are shown in disassembled position.
Figure 21:
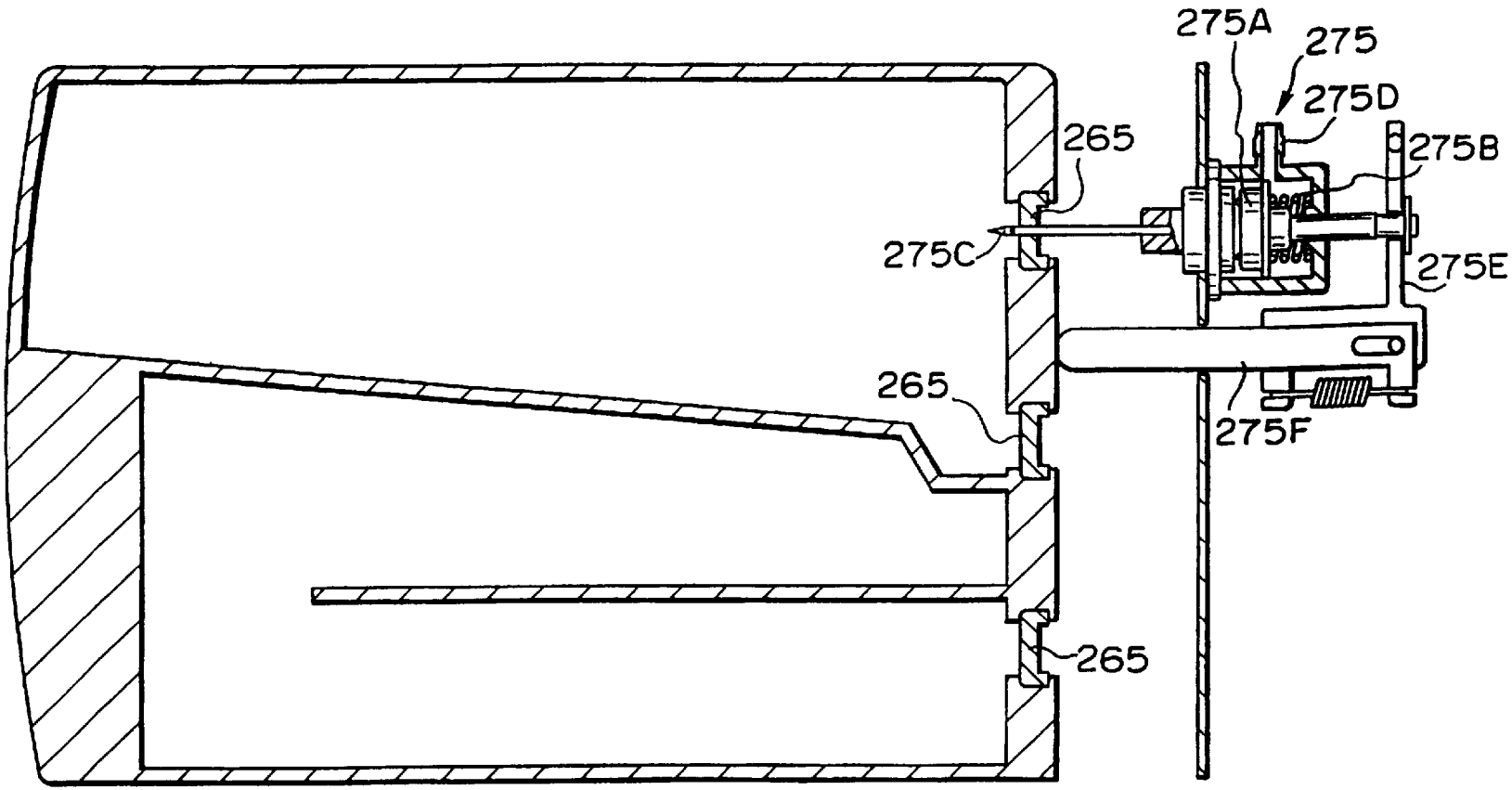
FIG. 21 is a section showing an intermediate condition in loading or unloading of the ink cartridge and the ink supply needle unit.
Figure 22:
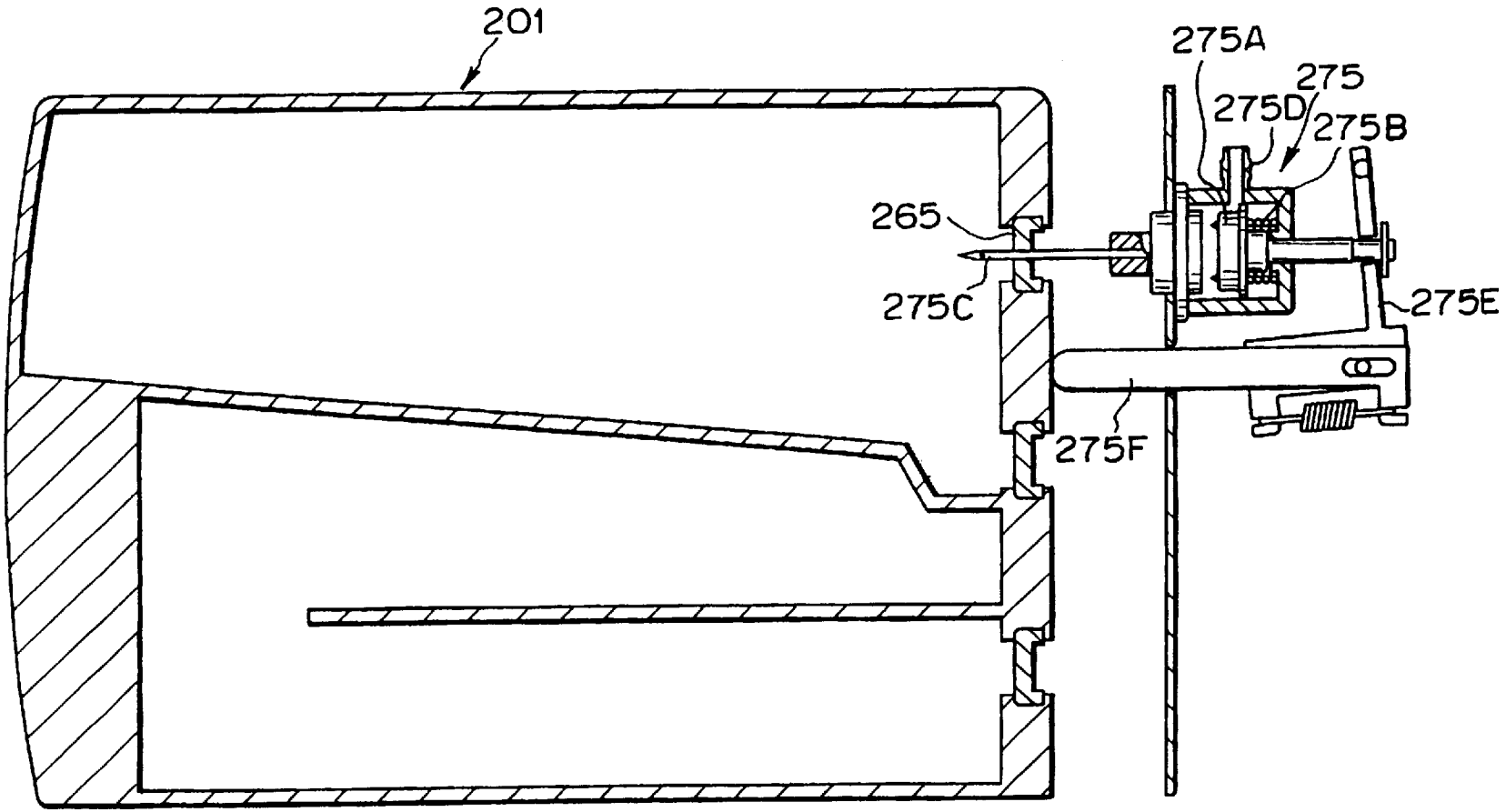
FIG. 22 is a section showing the ink cartridge and the ink supply needle unit in the loaded condition.

FIGS. 20 to 22 are illustration for explaining positional relationship between the needle 275C of the supply needle unit 275 and the ink cartridge 201, in the loading position.

At first, immediately before contacting the needle 275C with the rubber plug 265 of the ink cartridge 201 associating with loading of the ink cartridge 201, no force is exerted on the lever 275F. Therefore, the valve 275A is biased by the spring 275B to be held in the position blocking communication between the connection tube 275D and the needle 275C.

Next, as the ink cartridge 201 is further advanced for loading, as shown in FIG. 21, the lever 275F of the supply needle unit 275 comes into contact with a part of the ink cartridge 201. At this timing, a portion having the communication opening of the tip end of the needle 275C already passes through the rubber plug 265 and placed within the ink cartridge 201. On the other hand, at this time, the lever 275F has just come into contact with the part of the ink cartridge 201, the depression force of the ink cartridge 201 is not yet acted on lever 275F. Accordingly, the communication between the connection tube 275D and the needle 275C is still blocked.

Next, by further advancement of the ink cartridge 201 in the loading direction, as shown in FIG. 22, the depression force of the ink cartridge 201 acts on the lever 275F to depress the latter. By this, a connection lever 275E is shifted toward right in FIG. 22 about one end serving as pivot point. As a result, the connection lever 275E and the valve 275A are shifted rightwardly against the biasing force of the spring 275B to establish communication between the connection tube 275D and the needle 275C.

As can be clear from the discussion with respect to FIGS. 20 to 22, the supply needle unit 275 for ink recirculation from the ink storage chamber 203 to the cartridge 201 initially penetrate the tip portion of the needle carrying the communication opening into the ink cartridge 201 and subsequently open the valve 275A, associating with insertion of the ink cartridge 201 into the cartridge receptacle chamber 140 upon loading. In other words, the relationship of the length of the lever 275F and the length of the needle 275C is determined to certainly cause the sequence of actions set forth above.

With the construction set forth above, a problem that the valve 275A is opened before the needle 275C is inserted into the ink cartridge 201 to cause the ink from the ink storage chamber 203 to leak into the apparatus through the communication opening of the needle 275C, can be successfully prevented.

FIGS. 23 to 26 are illustration showing a head connector 289 and a transfer station 285 provided at a part of the ink supply path and establish connection of the supply tubes.

In the shown embodiment, since four kinds of inks, i.e. yellow (Y), magenta (M), cyan (C) and black (Bk), are employed, four ink supply paths are present. Accordingly, it becomes necessary that respective head connectors and the kinds of the inks are corresponded and the head connectors corresponded to the kinds of inks are set corresponding to the transfer station 285.

Figure 23:
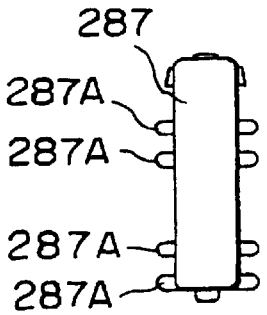
FIG. 23 is a front elevation of a head connector before assembling of the printer.
Figure 24:
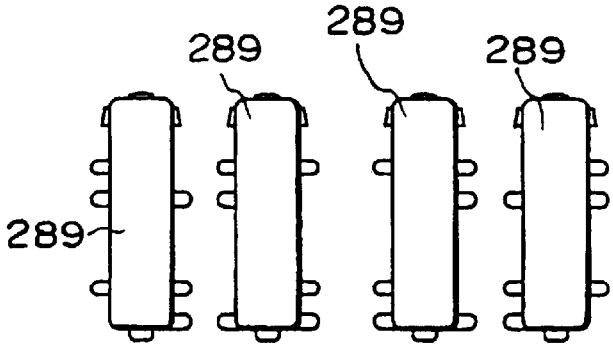
FIG. 24 is a front elevation of the head connector corresponding to respective inks after assembling of printer.

Therefore, as shown in FIG. 23, the head connector 289 in assembling of printer has respectively four bosses 287A at both sides. During assembling, the bosses 287A located at the positions corresponding to respective kinds of inks are cut away to form the head connector 289 after completion of assembling.

Figure 25:
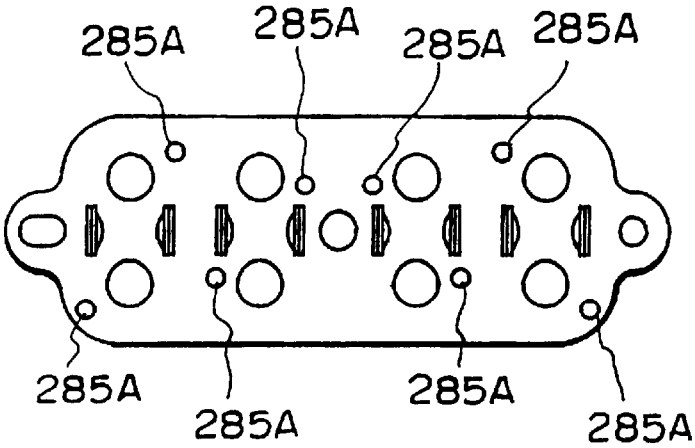
FIG. 25 is a front elevation of a transfer station.
Figure 26:
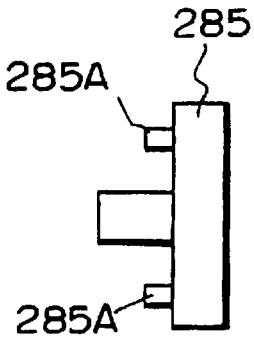
FIG. 26 is a right side elevation of the transfer station shown in FIG. 25.

On the other hand, as shown in the front elevation of FIG. 25 and right side elevation of FIG. 26, the transfer station 285 pairs of bosses 285A are diagonally arranged. Respective positions of the bosses 285A corresponds to the positions of the bosses of the head connectors 287 which are cut away for identifying the corresponding kind of the ink. With the construction set forth above, the head connector 289 will never set at erroneous position. Thus, a problem of color mixing can be successfully prevented.

Figure 27:
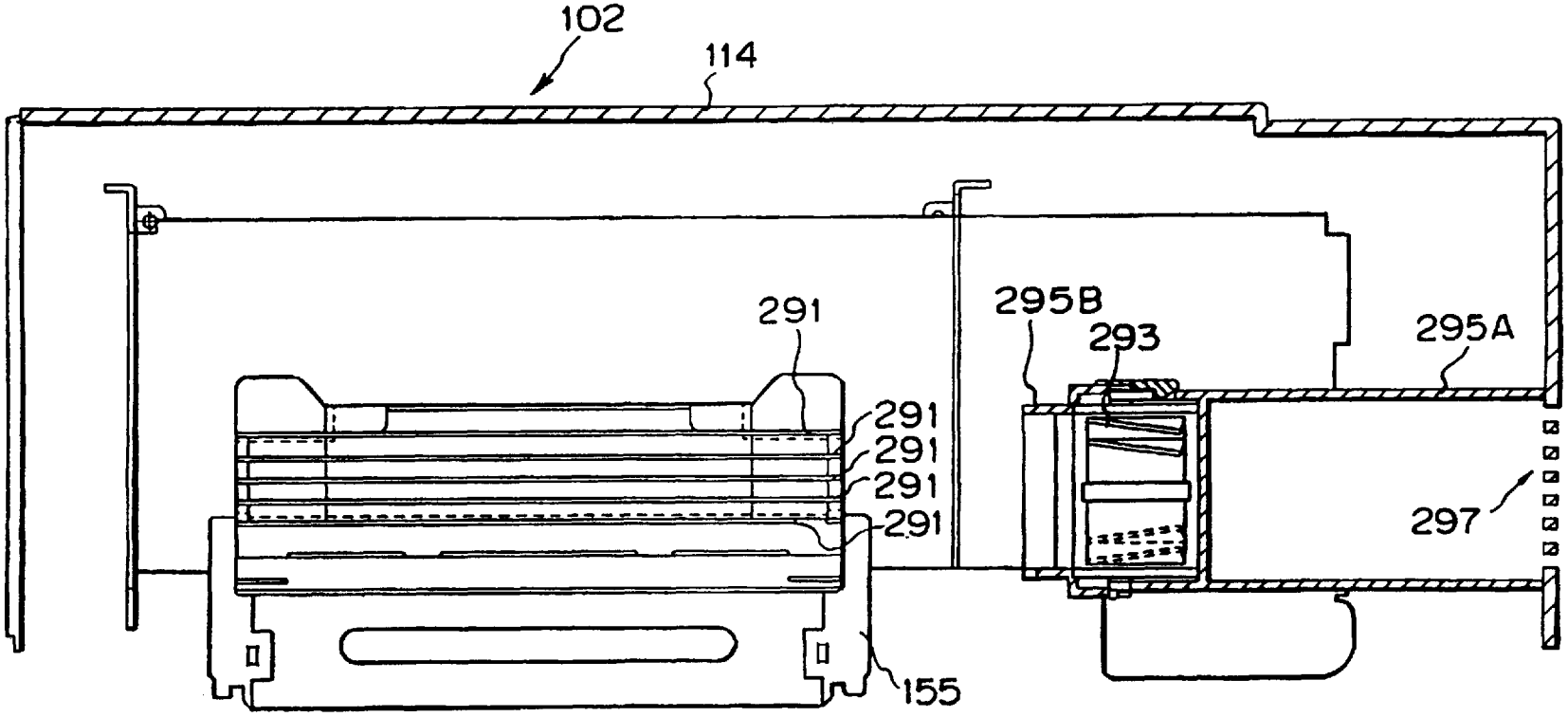
FIG. 27 is a section showing a positional relationship between a head cooling fin and fan.

FIG. 27 is a section showing a part of the printing head 102 shown in FIG. 1 and so forth.

Figure 28:
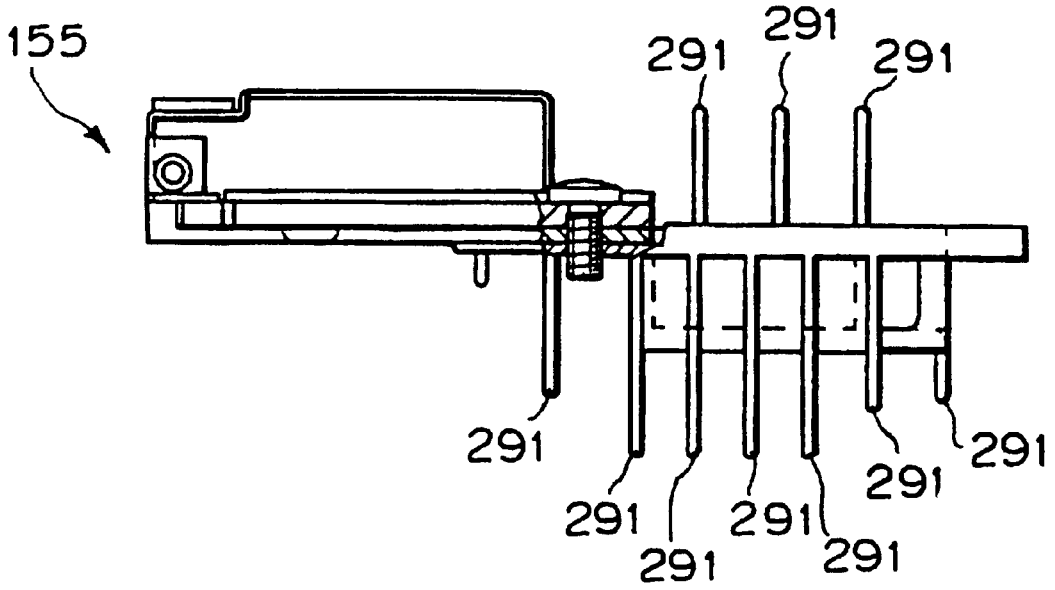
FIG. 28 is a partial section showing a fin and an ink jet head.

On each ink-jet head 155, as shown in FIG. 28, a plurality of fins 291 extending in overall length of the head in the longitudinal direction are provided. For generating an air flow along the longitudinal direction of the fines, a fan 293 is provided. The fan 293 is adapted to be driven by a not shown motor. At the front side and rear side of the fan 293, ducts 295A and 295B are provided. The duct 295A is communicated with the atmosphere via a louver 297 formed in a par of the cover member 114. By this, relatively low temperature air can be taken from the outside of the printer.

What is claimed is:

1. A printer into which an ink-jet head and an ink container are receivable, said ink-jet head for ejecting ink to perform printing on a printing medium and said ink container for storing the ink to be supplied to said ink-jet head, said printer comprising:

an ink storage container for temporarily storing the ink to be supplied from said ink container to said ink-jet head, said ink storage container having a closable air communicating portion communicating with ambient air;

a first ink path which connects said ink container to said ink storage container, and which defines a flow of ink from said ink container to said ink storage container, said first ink path being provided with a one-way flow restricting member for permitting only a flow of ink in a direction of discharge from said ink container;

a second ink path which connects said ink storage container to said ink container, and which defines a flow of ink for returning an excess amount of ink over a predetermined liquid amount in said ink storage container to said ink container;

opening/closing means for opening and closing said air communicating portion to ambient air;

a buffer container provided at a portion of said first ink path between said one-way flow restricting member and said ink storage container, said buffer container being capable of maintaining a predetermined liquid amount; and transfer means for transferring ink from said buffer container, said transfer means being provided at a portion of said first ink path between said buffer container and said ink storage container.

2. The printer according to claim 1, further comprising said buffer container being connected to a third ink tank path for supplying ink from said buffer container to said ink-jet head.

3. The printer as claimed in claim 2, wherein said third ink path is provided with a one-way flow restricting member for permitting only a flow of ink from said buffer container to said ink-jet head.

4. The printer as claimed in claim 1, wherein said ink transfer means comprises a pump configured to generate ink flows both from said ink container to said ink storage container and from said ink storage container to said buffer container.

5. The printer as claimed in claim 4, wherein said pump is comprised by a tube pump.

6. The printer as claimed in claim 1, wherein said opening/closing means is operable so as to permit ink to be replenished from said ink container to said ink storage container when said opening/closing means has closed said air communicating portion.

7. The printer as claimed in claim 6, further comprising said buffer container being connected to a third ink path for supplying ink from said buffer container to said ink-jet head, wherein when said opening/closing means has closed said air communicating portion, said transfer means causes flow of ink from said ink container to said ink storage container.

8. The printer as claimed in claim 1, wherein said opening/closing means is operable so as to permit ink to be supplied from said ink storage container to said ink-jet head when said opening/closing means has opened said air communicating portion.

9. The printer as claimed in claim 8, further comprising said buffer container being connected to a third ink path for supplying ink from said buffer container to said ink-jet head, wherein when said opening/closing means has opened said air communicating portion, ink transfer by said transfer means is stopped.

10. The printer as claimed in claim 1, further comprising said buffer container being connected to a third ink path for supplying ink from said buffer container to said ink-jet head, wherein when said opening/closing means has opened said air communicating portion, ink recovery from said ink-jet head is caused by said transfer means forcing flow of ink from said ink storage container to said buffer container.

11. The printer as claimed in claim 1, further comprising an ink path which connects said ink-jet head to said ink storage container.

12. The printer as claimed in claim 11, further comprising a second buffer container provided at said ink path connecting said ink-jet head to said ink storage container, said second buffer container being capable of maintaining a predetermined liquid amount, and further comprising second transfer means for transferring ink, said second transferring means being provided at a portion of said ink path connecting said ink-jet head to said ink storage container between said second buffer container and said ink storage container.

* * * * *

UNITED STATES PATENT AND TRADEMARK OFFICE

CERTIFICATE OF CORRECTION

PATENT NO. : 6,283,585 B1
DATED : September 4, 2001
INVENTOR(S) : Ikkatai et al.

It is certified that error appears in the above-identified patent and that said Letters Patent is hereby corrected as shown below:

Column 1,
Line 34, "problem" should read -- problems --;
Line 46, "associating" should read -- associated --;
Line 47, "may" should read -- may be --; and
Line 57, "problem" should read -- problems --.

Column 2,
Line 4, "an" (second occurrence) should read -- a --;
Line 9, "an" should read -- a --;
Line 25, "associating" should read -- associated --;
Line 37, "ciating" should read -- ciated --;
Line 53, "pivotably" should read -- pivotally --;
Line 57, "relating" should read -- relating to --; and
Line 61, "cartridge," should read -- cartridge. --.

Column 3,
Lines 17 and 25, "performed" should read -- performed by --;
Lines 37 and 54, "associating" should read -- associated --; and
Lines 49 and 50, "waster" should read -- waste --.

Column 4,
Line 2, "tative" should read -- ted --;
Line 21, "constriction" should read -- construction --; and
Line 24, "a" (second occurrence) should read -- an --.

Column 5,
Line 14, "instance," should read -- instances, --;
Line 15, "unnecessary" should read -- unnecessarily --;
Line 41, "pars," should read -- parts, --; and
Line 66, "condition" should read -- conditions.

Column 6,
Line 14, "roller" should read -- rollers --;
Line 22, "in" should read -- is --;
Lines 35 and 38, "slide" should read -- slid --;
Line 53, "comprises" should read -- comprise -- and "to" should be deleted;
Line 56, "to" should be deleted; and
Lines 60 and 62, "in oblique" should read -- obliquely --.

UNITED STATES PATENT AND TRADEMARK OFFICE

CERTIFICATE OF CORRECTION

PATENT NO. : 6,283,585 B1
DATED : September 4, 2001
INVENTOR(S) : Ikkatai et al.

It is certified that error appears in the above-identified patent and that said Letters Patent is hereby corrected as shown below:

Column 7,
Line 23, "pivotably" should read -- pivotally --; and
Line 44, "in respective of" should read -- with respect to --.

Column 8,
Line 2, "drive," should read -- drive --;
Line 9, "an" should be deleted;
Lines 33 and 36, "an" should read -- a --; and
Line 67, "buy" should read -- by --.

Column 9,
Line 6, "process" should read -- processes --;
Lines 15 and 47, "if" should read -- of --;
Line 50, "Associating" should read -- Associated --;
Line 62, "is" (second occurrence) should read -- and is --; and
Line 65, "semicicular," should read -- semicircular portion, --.

Column 10,
Line 3, "pushes" should read -- push --;
Line 5, "force" should read -- forth --;
Line 18, "provided." should read -- provided --;
Line 28, "cause," should read -- cases, --;
Lin e 42, "20A" should read -- 203A -- and "follow" should read -- follows. --;
Line 43, "pivotably" should read -- pivotally --; and
Line 62, "released" should read -- is released --.

Column 11,
Line 15, "sandiwiches" should read -- sandwiched --;
Line 26, "a" should be deleted;
Line 27, "ends." should read -- end. --;
Line 45, "waster" should read -- waste --;
Line 49, "among" should be deleted;
Line 51, "259," should read -- 259. --; and
Line 52, "lever," should read -- lever. --.

UNITED STATES PATENT AND TRADEMARK OFFICE

CERTIFICATE OF CORRECTION

PATENT NO. : 6,283,585 B1
DATED : September 4, 2001
INVENTOR(S) : Ikkatai et al.

It is certified that error appears in the above-identified patent and that said Letters Patent is hereby corrected as shown below:

Column 12,
Lines 9 and 21, "left" should read -- the left --;
Line 31, "right" should read -- the right --;
Line 41, "illustration" should read -- illustrations --;
Line 52, "restricted" should read -- restricted to a --;
Line 60, "lever 142 A," should read -- lever 142A. --; and
Line 61, "abut" should read -- abuts --.

Column 13,
Line 19, "illustration" should read -- illustrations --;
Line 23, "associating" should read -- associated --;
Line 34, "placed" should read -- is placed --; and
Line 45, "right" should read -- the right --.

Column 14,
Line 1, "illustration" should read -- should read -- illustrations --;
Line 8, "the" (first occurrence) should be deleted;
Line 20, "corresponds" should read -- correspond --;
Line 22, "the" (second occurrence) should be deleted.
Line 32, "fines," should read -- fins, --; and
Line 37, "par" should read -- part --.

Column 15,
Line 19, "by" should read -- of --.

Signed and Sealed this

Ninth Day of July, 2002

*Attest:*

*Attesting Officer*

JAMES E. ROGAN
*Director of the United States Patent and Trademark Office*